US012673707B2

(12) United States Patent
Allen et al.

(10) Patent No.: US 12,673,707 B2
(45) Date of Patent: Jul. 7, 2026

(54) SYSTEM AND METHOD FOR VIRTUAL BLOCK STICK CIRCUITS

(71) Applicant: BNSF Railway Company, Fort Worth, TX (US)

(72) Inventors: Jeffrey R. Allen, Olathe, KS (US); Michael E. Ramolt, Shawnee, KS (US); Brent A. Russell, Olathe, KS (US); Kent Robert Shue, Bonner Springs, KS (US)

(73) Assignee: BNSF Railway Company

( * ) Notice: Subject to any disclaimer, the term of this patent is extended or adjusted under 35 U.S.C. 154(b) by 86 days.

(21) Appl. No.: 18/915,069

(22) Filed: Oct. 14, 2024

(65) Prior Publication Data

US 2025/0033679 A1 Jan. 30, 2025

Related U.S. Application Data

(60) Continuation of application No. 18/051,275, filed on Oct. 31, 2022, now Pat. No. 12,116,028, which is a (Continued)

(51) Int. Cl.
*B61L 1/02* (2006.01)
*B61L 1/16* (2006.01)

(Continued)

(52) U.S. Cl.
CPC ..... *B61L 11/08* (2013.01); *B61L 1/188* (2013.01); *B61L 7/088* (2013.01); *B61L 21/10* (2013.01);

(Continued)

(58) Field of Classification Search
None
See application file for complete search history.

(56) References Cited

U.S. PATENT DOCUMENTS 5,332,180 A 7/1994 Peterson et al.
5,398,894 A * 3/1995 Pascoe ..... B61L 21/10 246/62

(Continued)

FOREIGN PATENT DOCUMENTS

CN 110603185 A 12/2019
EP 0638469 A2 2/1995

(Continued)

OTHER PUBLICATIONS

Diaz De Rivera, Adrian, et al. "Improving railway operational efficiency with moving blocks, train fleeting, and alternative single-track configurations." Transportation Research Record 2674.2 (2020): 146-157.

(Continued)

*Primary Examiner* — Adam D Tissot
(74) *Attorney, Agent, or Firm* — Whitaker Chalk Swindle & Schwartz PLLC; Bradley J. Birchfield

(57) ABSTRACT

A system and method for virtual block stick circuits is presented. The present disclosure implements specialized algorithms adapted to determine the true status of a virtual block based on multiple inputs from different perspectives. In one embodiment, the system can use the far house perspective of that virtual track segment and the PTC hazard for the near virtual track segment directly adjacent to the near house uses the near house perspective of that virtual track segment. For the middle virtual track segments, the near house perspectives of the middle virtual track segments are held 'TRUE' if they are already 'TRUE' when the train first enters the block, using stick circuits for the near house perspective of the middle track circuits. The vital application can then indicate the true state of the virtual track segment as occupied (FALSE), to protect the train from trains that follow.

20 Claims, 15 Drawing Sheets

Related U.S. Application Data continuation of application No. 17/502,918, filed on Oct. 15, 2021, now Pat. No. 11,511,779, which is a continuation-in-part of application No. 17/302,524, filed on May 5, 2021, now Pat. No. 11,230,307, which is a continuation of application No. 17/247,303, filed on Dec. 7, 2020, now Pat. No. 11,104,361, which is a division of application No. 15/965,680, filed on Apr. 27, 2018, now Pat. No. 10,894,550.

(60) Provisional application No. 62/502,224, filed on May 5, 2017.

(51) Int. Cl.

| | |
|---|---|
| ***B61L 1/18*** | (2006.01) |
| ***B61L 7/08*** | (2006.01) |
| ***B61L 11/08*** | (2006.01) |
| ***B61L 21/10*** | (2006.01) |
| ***B61L 23/16*** | (2006.01) |
| ***B61L 25/02*** | (2006.01) |
| *B61L 3/22* | (2006.01) |
| *B61L 23/04* | (2006.01) |
| *B61L 27/30* | (2022.01) |

(52) U.S. Cl.

CPC ..... *B61L 23/168* (2013.01); *B61L 3/221* (2013.01); *B61L 2011/086* (2013.01); *B61L 23/044* (2013.01); *B61L 27/30* (2022.01)

(56) References Cited

U.S. PATENT DOCUMENTS

| | | | | |
|---|---|---|---|---|
| 5,950,966 | A | 9/1999 | Hungate et al. | |
| 6,655,639 | B2 | 12/2003 | Grappone | |
| 6,666,411 | B1 | 12/2003 | Hart et al. | |
| 7,222,003 | B2 | 5/2007 | Stull et al. | |
| 8,170,732 | B2 | 5/2012 | Daum et al. | |
| 9,102,341 | B2 * | 8/2015 | Malone, Jr. | B61L 1/187 |
| 9,162,691 | B2 | 10/2015 | Polivka et al. | |
| 9,290,191 | B2 | 3/2016 | Ghaly | |
| 9,925,994 | B2 | 3/2018 | Ferrari et al. | |
| 10,081,379 | B2 | 9/2018 | Kull | |
| 10,894,550 | B2 | 1/2021 | Specht et al. | |
| 11,001,282 | B2 | 5/2021 | Tsujita et al. | |
| 11,021,178 | B2 | 6/2021 | Ghaly | |
| 11,827,256 | B1 | 11/2023 | Sapp et al. | |
| 12,330,701 | B2 | 6/2025 | McKenna | |
| 2003/0112131 | A1 | 6/2003 | Mcallister | |
| 2005/0075765 | A1 * | 4/2005 | Oguma | B61L 1/188 701/19 |
| 2013/0218375 | A1 * | 8/2013 | Ning | B61L 27/00 701/19 |
| 2013/0334373 | A1 | 12/2013 | Malone, Jr. et al. | |
| 2014/0014782 | A1 | 1/2014 | Grappone | |
| 2016/0107664 | A1 * | 4/2016 | Kull | B61L 23/044 246/121 |
| 2017/0113707 | A1 | 4/2017 | Ghaly | |
| 2018/0319413 | A1 | 11/2018 | Specht et al. | |
| 2019/0144023 | A1 | 5/2019 | Gao et al. | |
| 2019/0168788 | A1 | 6/2019 | Ghaly | |
| 2020/0207384 | A1 | 7/2020 | Dick et al. | |
| 2021/0139059 | A1 | 5/2021 | Schmidt et al. | |
| 2022/0185350 | A1 | 6/2022 | Kindt et al. | |
| 2023/0166780 | A1 | 6/2023 | Allen et al. | |
| 2024/0253677 | A1 | 8/2024 | Sapp et al. | |
| 2025/0033679 | A1 | 1/2025 | Allen et al. | |

FOREIGN PATENT DOCUMENTS

| | | | |
|---|---|---|---|
| EP | 3825205 | A1 | 5/2021 |
| JP | 0532166 | A | 2/1993 |
| JP | 101054 | A | 1/1998 |
| JP | 2005145089 | A | 6/2005 |
| WO | 2015180902 | A1 | 12/2015 |
| WO | 2018151747 | A1 | 8/2018 |
| WO | 2024163080 | A1 | 8/2024 |

OTHER PUBLICATIONS

International Search Report and Written Opinion regarding International Application PCT/US2018/030325, issued Aug. 6, 2018, 11 pages.

International Search Report and Written Opinion regarding International Application PCT/US2022/041523, issued Dec. 9, 2022, 13 pages.

* cited by examiner

SYSTEM AND METHOD FOR VIRTUAL BLOCK STICK CIRCUITS

CROSS-REFERENCE TO RELATED APPLICATIONS

The present application is a Continuation of U.S. patent application Ser. No. 18/051,275, filed Oct. 31, 2022, which is a Continuation of U.S. patent application Ser. No. 17/502,918, filed Oct. 15, 2021, which claims priority to U.S. patent application Ser. No. 17/302,524, filed May 5, 2021, which claims priority to U.S. patent application Ser. No. 15/965,680, filed Apr. 27, 2018, which claims the benefit of U.S. Provisional Application No. 62/502,24, filed May 5, 2017, the entireties of which are herein incorporated by reference for all purposes.

TECHNICAL FIELD

The present invention relates in general to railroad signaling systems and in particular to a railroad virtual track block system.

BACKGROUND

Block signaling is a well-known technique used in railroading to maintain spacing between trains and thereby avoid collisions. Generally, a railroad line is partitioned into track blocks and automatic signals (typically red, yellow, and green lights) are used to control train movement between blocks. For single direction tracks, block signaling allows trains to follow each other with minimal risk of rear end collisions.

However, conventional block signaling systems are subject to at least two significant disadvantages. First, track capacity cannot be increased without additional track infrastructure, such as additional signals and associated control equipment. Second, conventional block signaling systems cannot identify broken rail within an unoccupied block.

Railroad signal standard practice for the design and function of signal systems is based upon the concept of a vital system. A vital system is often characterized as being failsafe and consistent with the closed-circuit principle. A system is failsafe if the failure of any element of the system causes the system to revert to its safest condition. In the case of railroad wayside systems, failsafe design requires that if any element necessary to the safe and proper operation of the system cannot perform its intended function that the system will revert to the safest condition, A vital system is in conformance with the closed-circuit principle because the components of the system do not share elements which could afford alternative energy or logic paths, as these elements would violate the failsafe principle.

Moving high density block systems transmit voltage and current down a rail to measure rail resistance. When a train approaches a measured rail segment, the axel connecting two wheels effectively shunt the rail circuit, such that the shunt can be used to determine where a train is located with the measured physical blocks. However, a shunt can indicate the location of a train, or the location of a hazard, such as a rail break or other hazard type.

Current Onboard Movement Authority (OMA)-Virtual Block System (VBS) Positive Train Control (PTC) (OMA-VBS PTC) track databases require hazards to be paired with an opposing hazard. Due to limitations, the locomotive onboard computer is unable to perform a logical 'OR' on the virtual track segments, the locomotive onboard can only perform a logical 'AND.' This creates an issue when a train first occupies a physical track circuit. The virtual track circuit segments within the train's own route change to a 'FALSE' state from the near house perspective which. when 'AND'-ed by the onboard computer with the far house perspective of the same virtual track segments, produce a 'FALSE' state for those track segments on the onboard display requiring the train to slow down or stop. These unnecessary slow-downs or stops negatively impact the efficiency of railroad operations.

SUMMARY

The principles of the present invention are embodied in a virtual "high-density" block system that advantageously increases the capacity of the existing track infrastructure used by the railroads. The present disclosure solves the technological problem of traditional block systems by dividing the current physical track block structure into multiple (e.g., four) segments or "virtual track blocks," train block spacing can be reduced to accurately reflect train braking capabilities. In particular, train spacing can be maintained within a physical track block by identifying train position with respect to virtual track blocks within that physical track block. The present disclosure introduces a "stick" logic concept, where the onboard system can mask certain states that may be unnecessary so the status of value can be acted upon appropriately for the onboard system.

The present disclosure provides a technological solution missing from conventional systems by at least implementing specialized algorithms adapted to determine the true status of a virtual block based on multiple inputs. In one embodiment, the PTC hazard for the far virtual track segment directly adjacent to the far house uses the far house perspective of that virtual track segment and the PTC hazard for the near virtual track segment directly adjacent to the near house uses the near house perspective of that virtual track segment. For the middle virtual track segments, the near house perspectives of the middle virtual track segments are held 'TRUE' if they are already 'TRUE' when the train first enters the block. This is accomplished using stick circuits for the near house perspective of the middle track circuits. Once the system determines the virtual block is healthy, the middle track circuits can be latched 'TRUE' in front of the train if they were already 'TRUE' when the train entered the physical block. The middle virtual track segments can be 'AND'-ed by the onboard computer with the far house perspective of the same middle virtual track segments which, if they are 'TRUE' from the far house perspective, can display clear virtual track segments. The middle virtual track segments can remain latched 'TRUE' until the preceding virtual track segment is unoccupied (TRUE). The vital application can then indicate the true state of the virtual track segment as occupied (FALSE), to protect the train from trains that follow. For opposing movements, the use of vital logic prevents on-board movement authority from being transmitted by the far house wayside vital processor.

In another embodiment, PTC signal device types can be used instead of track hazards. The logic can be similar in that the system can "stick" the middle signals 'TRUE' when a train enters the block to prevent the PTC signal device types from dropping FALSE in front of the train causing the train to stop or slow down.

It is an object of the disclosure to provide a system for virtual block detection within occupied virtual block using stick logic. It is a further object of the disclosure to provide a method of virtual block detection within occupied virtual block using stick logic. These and other objects of the disclosure are provided by at least the following embodiments.

In one embodiment, a system for virtual block detection within occupied virtual block using stick logic, can include: a memory having a first database with a plurality of messages, signal values, and specifications related to a vehicle and at least a portion of a track; and a computer processor operably coupled to the memory and capable of executing machine-readable instructions to perform program steps, the program steps can include: generate a plurality of virtual blocks within a physical block; associate a bit in a virtual block message with each of the plurality of virtual blocks to represent a virtual block state; receive an authority for a train up to a first location;

assign a second bit value to a first virtual block bit in the message when the train occupies the first virtual block; determine, via the computer processor, whether one or more virtual block states are irrelevant to a virtual block occupancy determination based at least in part on the train's position; and assign, via the computer processor, a first bit value to the irrelevant virtual block bits regardless of the train's presence in the virtual block. The program steps further comprising assigning a bit associated with a virtual block to the first bit value when the train leaves the first virtual block. Wherein the first bit value indicates the absence of a train or a hazard in a virtual block. Wherein the first bit value is high. Wherein the high bit value is associated with a logical '1.' Wherein the second bit value indicates the presence of a train or a hazard in a virtual block. Wherein the second bit value is low. Wherein the low bit value is associated with a logical '0.' Wherein the computer processor can mask the irrelevant virtual block bits so it can be acted upon appropriately by or for the onboard system. Wherein the virtual block state indicated whether the virtual block is occupied or unoccupied.

In another embodiment, a method of virtual block detection within occupied virtual block using stick logic, can include: generating a plurality of virtual blocks within a physical block; associating a bit in a message with each of the plurality of virtual blocks to represent a virtual block state; receiving an authority for a train up to a first location; assigning a second bit value to a first virtual block bit in the message when the train occupies the first virtual block; determining, via control logic, whether one or more virtual block states are irrelevant to a virtual block occupancy determination based at least in part on the train's position; and assigning, via the control logic, a first bit value to the irrelevant virtual block bits regardless of the train's presence in the virtual block. Further comprising assigning a bit associated with a virtual block to the first bit value when the train leaves the first virtual block. Wherein the first bit value can indicate the absence of a train or a hazard in a virtual block. Wherein the first bit value can be high. Wherein the high bit value can be associated with a logical '1.' Wherein the second bit value indicates the presence of a train or a hazard in a virtual block. Wherein the second bit value can be low. Wherein the low bit value can be associated with a logical '0.' Wherein the control logic can mask the irrelevant virtual block bits so it can be acted upon appropriately by or for the onboard system. Wherein the virtual block state can indicate whether the virtual block is occupied or unoccupied.

BRIEF DESCRIPTION OF THE DRAWINGS

The present disclosure will be readily understood by the following detailed description, taken in conjunction with the accompanying drawings that illustrate, by way of example, the principles of the present disclosure. The drawings illustrate the design and utility of one or more exemplary embodiments of the present disclosure, in which like elements are referred to by like reference numbers or symbols. The objects and elements in the drawings are not necessarily drawn to scale, proportion, or precise positional relationship. Instead, emphasis is focused on illustrating the principles of the present disclosure.

DETAILED DESCRIPTION

Figure 1:
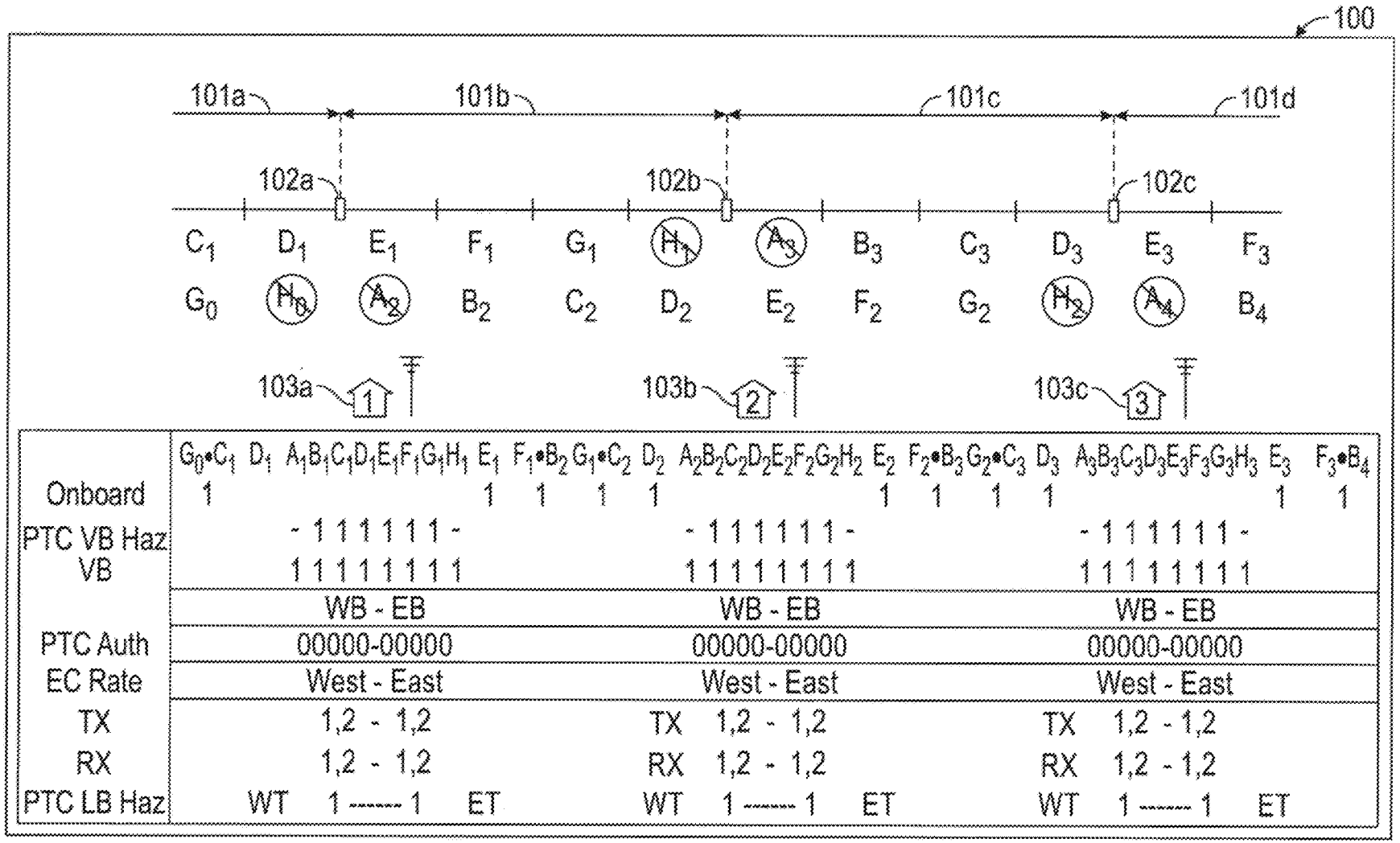
FIG. 1 illustrates a diagram showing a representative number of unoccupied physical railroad track blocks, along with associated signaling (control or wayside) houses, with each physical track block partitioned into a selected number of virtual track blocks, and a listing of certain messages and their corresponding values, in accordance with one or more exemplary embodiments of the present disclosure.

The disclosure presented in the following written description and the various features and advantageous details thereof, are explained more fully with reference to the non-limiting examples included in the accompanying drawings and as detailed in the description, which follow. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can visualize or recognize the members of the genus. Accordingly, these examples should not be construed as limiting the scope of the claims.

Generally, track circuits exist to provide train and broken rail detection and can also convey data from one house to another. The limits of a two-mile physical track section can be broken up from an adjoining two-mile track section with an insulated joint, such as a clear plastic joint within the rail.

The system disclosed herein can include a transceiver disposed proximate a wayside house that can transmit a signal down the rail and receive the signal at a second wayside house. When a block is occupied by a train for example, the transmitted signal can be redirected back to the transceiver. In one embodiment, the system can include a transmission circuit that can transmit down one rail through a train axle and receiving the signal on a second rail. A current resistance circuit can determine that actual location of the axel based upon, for example resistance measurements, time delay, or other suitable means. The system can also include a chassis, a vital logic controller that resides in each of wayside house, and a contact for an occupied block, among other components. Additionally, states can be defined within a ladder logic application. The ladder logic can be implemented within the vital controller in the houses and can consume these inputs and determine what is broadcast to the onboard computer. The ladder logic can determine the stick values and bit numbers and can determine virtual block statuses based on inputs from the chassis measurements. The system can also include a PTC interoperable messaging standard that can communicate information from the wayside to the onboard. In another embodiment, the messaging standard can include a portion of the payload that can be defined by a railroad to communicate additional information. The fields, characteristics, and values detailed below can be transmitted as part of this payload.

The section of track depicted in FIGS. 1-14 represents physical track blocks 101*a*, 101*b*, 101*c*, and 101*d*, with physical track blocks 101*a* and 101*d* partially shown and physical track blocks 101*b* and 101*c* shown in their entirety. Physical track blocks 101*a*-101*d* can be separated by conventional insulated joints 102*a*, 102*b*, and 102*c*. Signal control houses 103*a* (#1), 103*b* (#2), and 103*c* (#3) can be associated with respective insulated joints 102*a*-102*c*. Each signaling house 103 can transmit on the track on both sides of the corresponding insulated joint 102.

In one embodiment, each physical track block 101*a*-101*d* can be partitioned into multiple virtual track blocks or "virtual track blocks." In the illustrated embodiment, these virtual track blocks can each represent one-quarter (25%) of each physical track block 101*a*-101*d*, although in alternate embodiments, the number of virtual track blocks per physical track block can vary. In FIGS. 1-14, house #1 (103*a*) can be associated with virtual track blocks $A_1$-$H_1$ ($C_1$-$H_1$ shown), house #2 (103*b*) can be associated with virtual track blocks $A_2$-$H_2$, and house #3 (103*c*) can be associated with virtual track blocks $A_3$-$H_3$ ($A_3$-$F_3$ shown). The track can continue with this convention indefinitely for additional houses and additional sections of track. For example, house #4 (not shown) can be associated with virtual track blocks $A_4$-$H_4$ ($A_4$-$B_4$ shown).

In other words, in the illustrated embodiment, each house 103 can be associated with four (4) virtual track blocks to the left (e.g., west-bound perspective) of the corresponding insulated joint 102 (e.g., virtual track blocks $A_1$-$D_1$) and four (4) virtual track blocks to the right (e.g., east-bound perspective) of the corresponding insulated joint 102 (e.g., virtual track blocks $E_1$-$H_1$), for a total of eight virtual blocks ($A_1$-$H_1$). In this configuration, virtual track blocks can overlap. In one embodiment, the east-bound perspective virtual track blocks for house #1 103*a* can overlap the west-bound perspective virtual track blocks for house #2 103*b*, such that each overlapping virtual block can have two variables to represent it, based on the perspective-house #1 or house #2. For example, virtual track blocks $E_1$-$H_1$ associated with house #1 can overlap with virtual track blocks $A_2$-$D_2$ associated with house #2, such that virtual block $F_1$ (from the house #1 perspective) and virtual block $B_2$ (from the house #2 perspective) correspond to the same virtual block from the perspective of different houses. This provides the advantage of being able to have two views of the same virtual block, so that should one view be blocked (e.g., due to the shunting of a proximate virtual block), the other view can provide a view of the overlapped virtual block. For purposes of this disclosure a particular virtual block can be represented as the virtual block from each house's perspective with a logical AND operator (·) between each variable (e.g., $F_1 \cdot B_2$, $F_2 \cdot B_3$, etc.).

The system can measure the track resistance and can take into account many other safety-critical calculations, such as the non-linear track resistance, rail temperature variability, and rail stress variability, among other factors. In one embodiment, the system can also determine a distance of where a track is shunted (e.g., distance from a house 103) and normalize it into one of, for example, four locations within that track circuit (e.g., corresponding with a particular virtual block).

A four-virtual track block can correspond with 25% of the physical length to yield four bits for a specific track circuit—one bit for each virtual block. The system can determine and set the state of those bits (e.g., high (1) or low (0)) based on what is known about the location of the train at that time. The four bits can define the status of these known segments of rail. In another embodiment, the system can define the state of those four virtual blocks from the perspective of two houses as the virtual blocks of two houses will overlap any given track segment. Accordingly, the four bits can represent the state of the, e.g., two-mile track section from the eastern perspective and from the western perspective, so both ends have a specific status. The onboard's responsibility can be to act on both of those statuses. In another embodiment, the system can "stick" certain values high when it is determined that those values are not relevant because of the train position and use only those bits having relevant information for the onboard to act.

In one embodiment, certain statuses can be crossed out (e.g., $H_0$, $A_2$, $H_1$, $A_3$, $H_2$, $A_4$, etc.) on either side of an insulated joint 102 because relative to a particular virtual block there is no other house that knows the state of that particular virtual block better than the house located at the insulated joint 102. If the house located at the insulated joint 102 sees a shunt, it is clear that there is a shunt there, as opposed to some other house due to the visibility limitations associated with a shunt. For example, house #3 103*c* cannot see past a shunted virtual block in, for example virtual block $C_3 \cdot G_2$, so all virtual block states on the other side of $C_3$ from the perspective of house #3 103*c* will be low (indicating occupancy), but that is not the case for house #2 related to this virtual block since house #2 has an unimpeded view to block $C_3 \cdot G_2$. So the system can determine that, in this example, virtual block $B_3 \cdot F_2$ is unoccupied, even though house #3 may indicate that it is occupied because that virtual block is blocked from its perspective. As such, the system can discard the statuses for the virtual blocks that are known based on the house having the best perspective. The middle two virtual blocks can be more difficult to determine because their status can depend on the direction of the train, particularly as to whether the statuses are blocked from visibility or not.

Each FIG. 1-14 includes a table having different message types and corresponding values for each message type based upon the occurrence depicted in the figure. Onboard represents the virtual block status sent to the onboard computer as explained in more detail below. PTC Virtual Block Hazard (PTC VB Haz) represents a PTC message and the specific payload is a device type of hazard, which is a single bit data. PTC Authentication (PTC Auth) represents a PTC message and the specific payload is a device type of signal authority which is a 5 bit status representing one piece of information. Virtual Block (VB) is the status of each virtual block for a particular house. Each one of the houses' vital logic controllers can receive these signals. In one embodiment, the vital logic controllers can be aggregated or slaved to another virtual logic controller. In another embodiment, the vital logic controller can transmit the messages to the onboard computer.

In one embodiment, the low state (occupied) can be configured to be the safe state. It is far more unsafe to assume that a block is unoccupied when it may actually be occupied, so the system must assume that a block is occupied. In another embodiment, the safe state can indicate that the block is occupied as a failure mode. In traditional signaling terminology the term "stick" can be used to define a variable that is held in a particular state after a pattern is established. The variable "sticks" to a predetermined value (e.g., high) because of a known condition.

FIG. 1 illustrates a track section with no trains in the vicinity. All three houses 103*a*-103*c* can generate and maintain a Virtual Block (VB) value of 11111111 representing unoccupied blocks in the corresponding virtual track blocks $A_i$-$H_i$ (e.g., i=0, 1, 2, 3, 4, etc.), respectively. In one embodiment a high (1) value can represent an unoccupied virtual block and a low (0) value can represented an occupied (or shunted) virtual block. From the perspective of house #3, eight virtual blocks can be established by the system 100—$A_3$, $B_3$, $C_3$, $D_3$, on the west side of the house, and $E_3$, $F_3$, $G_3$, and $H_3$ on the east side of the house. Referring to the table at the bottom of FIG. 1, the VB row represents the virtual block values, where one bit can represent every one of these track circuits from a particular house's 103*a*-103*c* perspective. From a train perspective, the system can broadcast this virtual track block information via the PTC Virtual Block Hazard (PTC VB Haz) to the train. The system can discard the virtual block statuses at the extreme ends of the VB values for a house 103. For example, in an 8-bit VB status, the $A_i$ and the $H_i$ statuses on the far ends can be discarded because the far house to the West can have a better perspective of the A-block status and the far house to the East can have a better perspective of the H-block status, due to their proximity to those virtual blocks. As such the system is configured to discard the statuses at the extremities of a virtual block grouping and stores the modified virtual block statuses in PTC VB Haz.

For the unoccupied segment of track shown in FIG. 1, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 1 | 1 | 1 | 1 | — |
| VB | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 |

For the unoccupied segment of track shown in FIG. 1, by 'AND'-ing the two overlapping perspectives for each virtual block, the system will generate and transmit the following virtual block statuses to the locomotive onboard computer:

| | Blk 101a | | | | Blk 101b | | | | Blk 101c | | | | Blk 101d | | | |
|---|---|---|---|---|---|---|---|---|---|---|---|---|---|---|---|---|
| House #1 | — | $B_1$ | $C_1$ | $D_1$ | $E_1$ | $F_1$ | $G_1$ | — | | | | | | | | |
| House #2 | | | | | — | $B_2$ | $C_2$ | $D_2$ | $E_2$ | $F_2$ | $G_2$ | — | | | | |
| House #3 | | | | | | | | | — | $B_3$ | $C_3$ | $D_3$ | $E_3$ | $F_3$ | $G_3$ | — |
| Onboard | 1 | 1 | 1 | 1 | 1 | 1 | 1 | 1 | 1 | 1 | 1 | 1 | 1 | 1 | 1 | 1 |

FIGS. 2-14 provide an exemplary embodiment of a westbound train passing house #3 and house #2, stopping by house #1. Further, as the virtual block overlapping can theoretically continue indefinitely on either side, only a section of track is presented, wherein house #2 has a full complement of virtual blocks, truncating two of the non-overlapping blocks for house #1 and house #3. These examples are intended to facilitate an understanding of the ways in which the disclosure can be implemented and practiced and should not limit the disclosure to only these examples.

Figure 2:
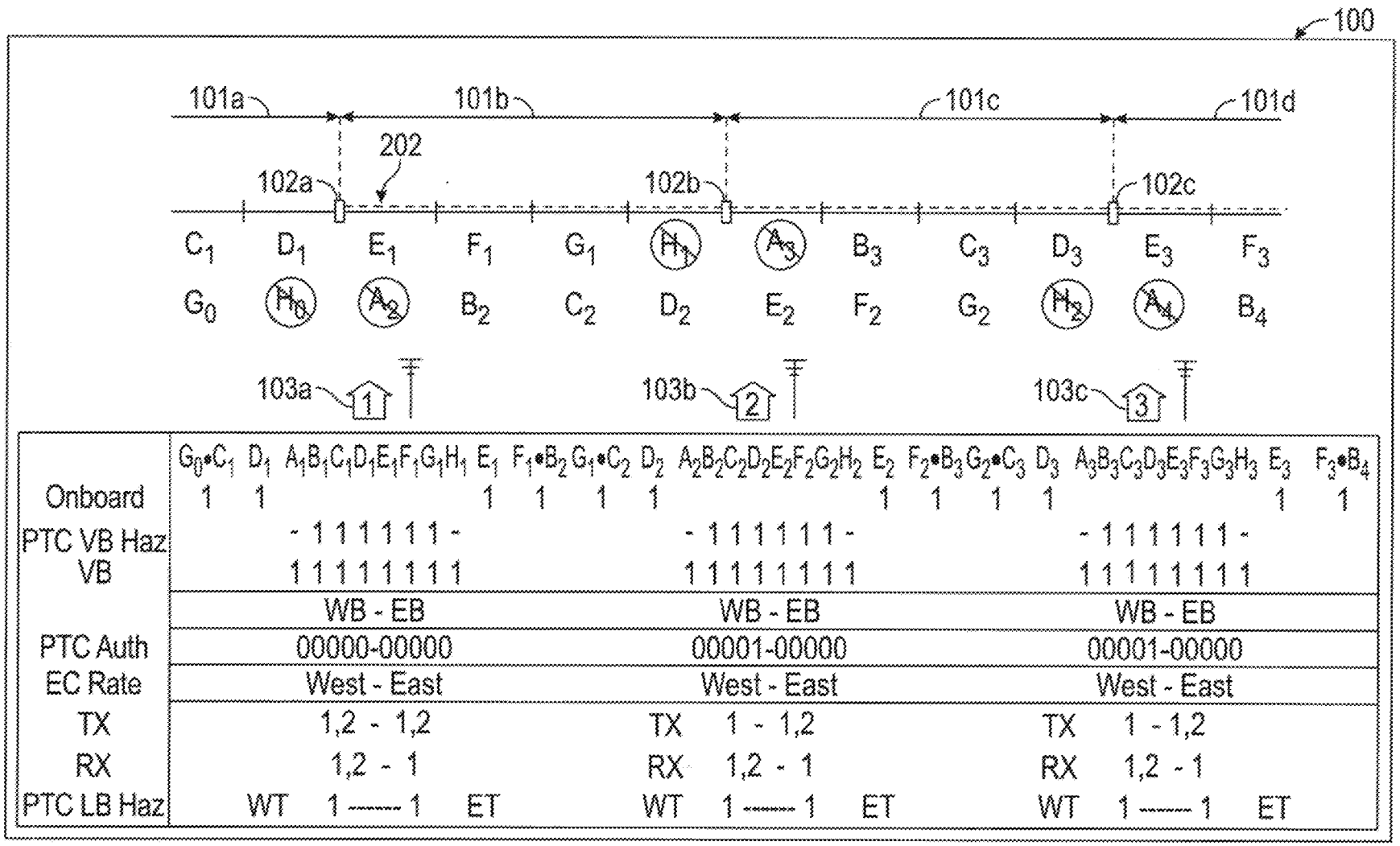
FIG. 2 illustrates a diagram showing the system of FIG. 1, with an authority line to the leftmost signaling house, and corresponding message values, in accordance with one or more exemplary embodiments of the present disclosure.

Referring to FIG. 2, the system 100 can line a movement authority 202 to a first location, such as house #1 103*a*. In one embodiment, the PTC Auth can be set to indicate passage through one or more houses 103. For example, when a movement authority is granted through house #3 and house #2, up to house #1, the west-bound flags (e.g., 1) can be set for PTC Auth value for house #3 and house #2. As the train will be moving from east to west on the tracks. Since the train only has movement authority up to house #1 (and not past it), the west-bound flag is not set for house #1.

Figure 3:
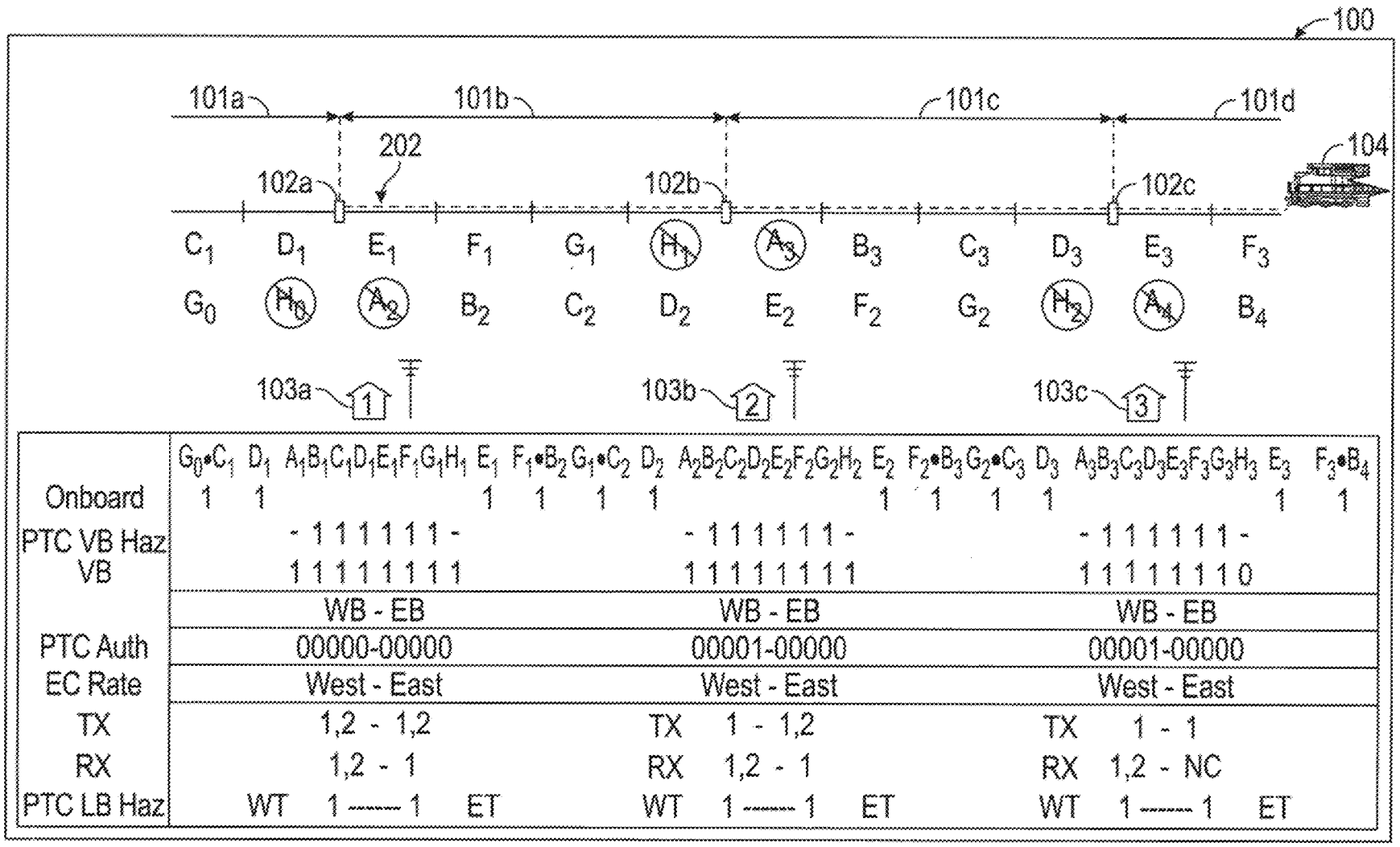
FIG. 3 illustrates a diagram showing the system of FIG. 1, with a westbound train approaching the rightmost signaling house and corresponding message values, in accordance with one or more exemplary embodiments of the present disclosure.

Referring to FIG. 3, as a train enters physical block 101*d* on its way to the first location (e.g., house #1), a train 104 can occupy and shunt a first stage virtual block (e.g., $H_3$ of house #3), setting the $H_3$ VB variable to '0.' The PTC VB Haz $H_3$ virtual block variable is in a "don't care" state as it is the furthest from house #3.

When the train 104 shunts virtual block $H_3$, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 1 | 1 | 1 | 1 | — |
| VB | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 |

When the train 104 shunts virtual block $H_3$, by 'AND'-ing the two overlapping perspectives for each virtual block, the system will generate and transmit the following virtual block statuses to the locomotive onboard computer:

| | Blk 101a | | | | Blk 101b | | | | Blk 101c | | | | Blk 101d | | | |
|---|---|---|---|---|---|---|---|---|---|---|---|---|---|---|---|---|
| House #1 | — | $B_1$ | $C_1$ | $D_1$ | $E_1$ | $F_1$ | $G_1$ | — | | | | | | | | |
| House #2 | | | | | — | $B_2$ | $C_2$ | $D_2$ | $E_2$ | $F_2$ | $G_2$ | — | | | | |
| House #3 | | | | | | | | | — | $B_3$ | $C_3$ | $D_3$ | $E_3$ | $F_3$ | $G_3$ | — |
| Onboard | | | 1 | 1 | 1 | 1 | 1 | 1 | 1 | 1 | 1 | 1 | 1 | 1 | | |

Figure 4:
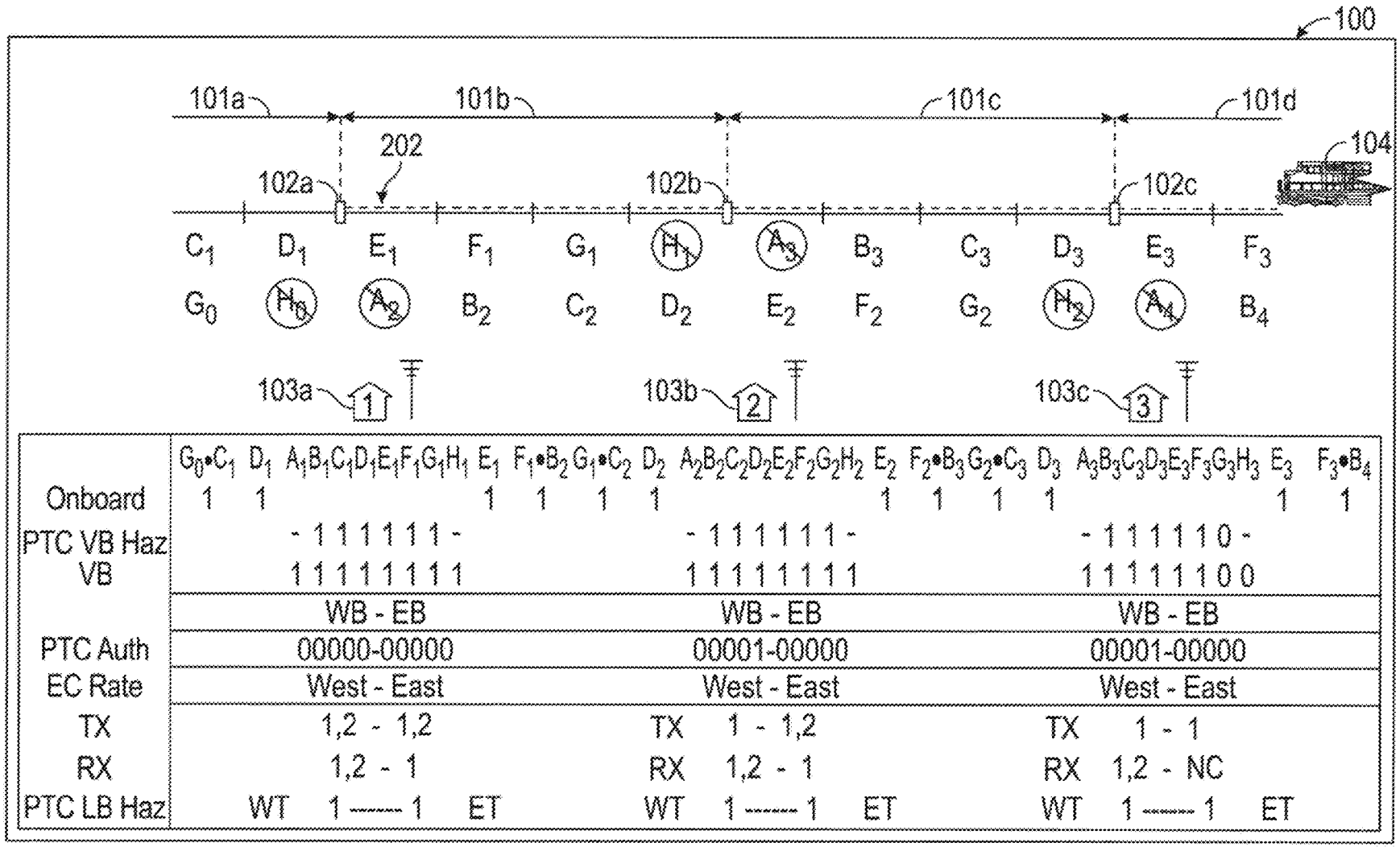
FIG. 4 illustrates a diagram showing the system of FIG. 1, with a westbound train entering a $G_3$ virtual block and corresponding message values, in accordance with one or more exemplary embodiments of the present disclosure.

Referring to FIG. 4, as the train continues west-bound, the train then occupies and shunts the $G_3$ virtual block. The $H_3$ VB value is low because from the perspective of house #3, the $G_3$ virtual block is blocking house #3's view of the $H_3$ virtual block.

When the train 104 shunts virtual block $G_3$, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 1 | 1 | 1 | 0 | — |
| VB | 1 | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 |

When the train 104 shunts virtual block $G_3$, by 'AND'-ing the two overlapping perspectives for each virtual block, the system will generate and transmit the following virtual block statuses to the locomotive onboard computer:

| | Blk 101a | | | | Blk 101b | | | | Blk 101c | | | | Blk 101d | | | |
|---|---|---|---|---|---|---|---|---|---|---|---|---|---|---|---|---|
| House #1 | — | $B_1$ | $C_1$ | $D_1$ | $E_1$ | $F_1$ | $G_1$ | — | | | | | | | | |
| House #2 | | | | | — | $B_2$ | $C_2$ | $D_2$ | $E_2$ | $F_2$ | $G_2$ | — | | | | |
| House #3 | | | | | | | | | — | $B_3$ | $C_3$ | $D_3$ | $E_3$ | $F_3$ | $G_3$ | — |
| Onboard | | | 1 | 1 | 1 | 1 | 1 | 1 | 1 | 1 | 1 | 1 | 1 | 1 | | |

Figure 5:
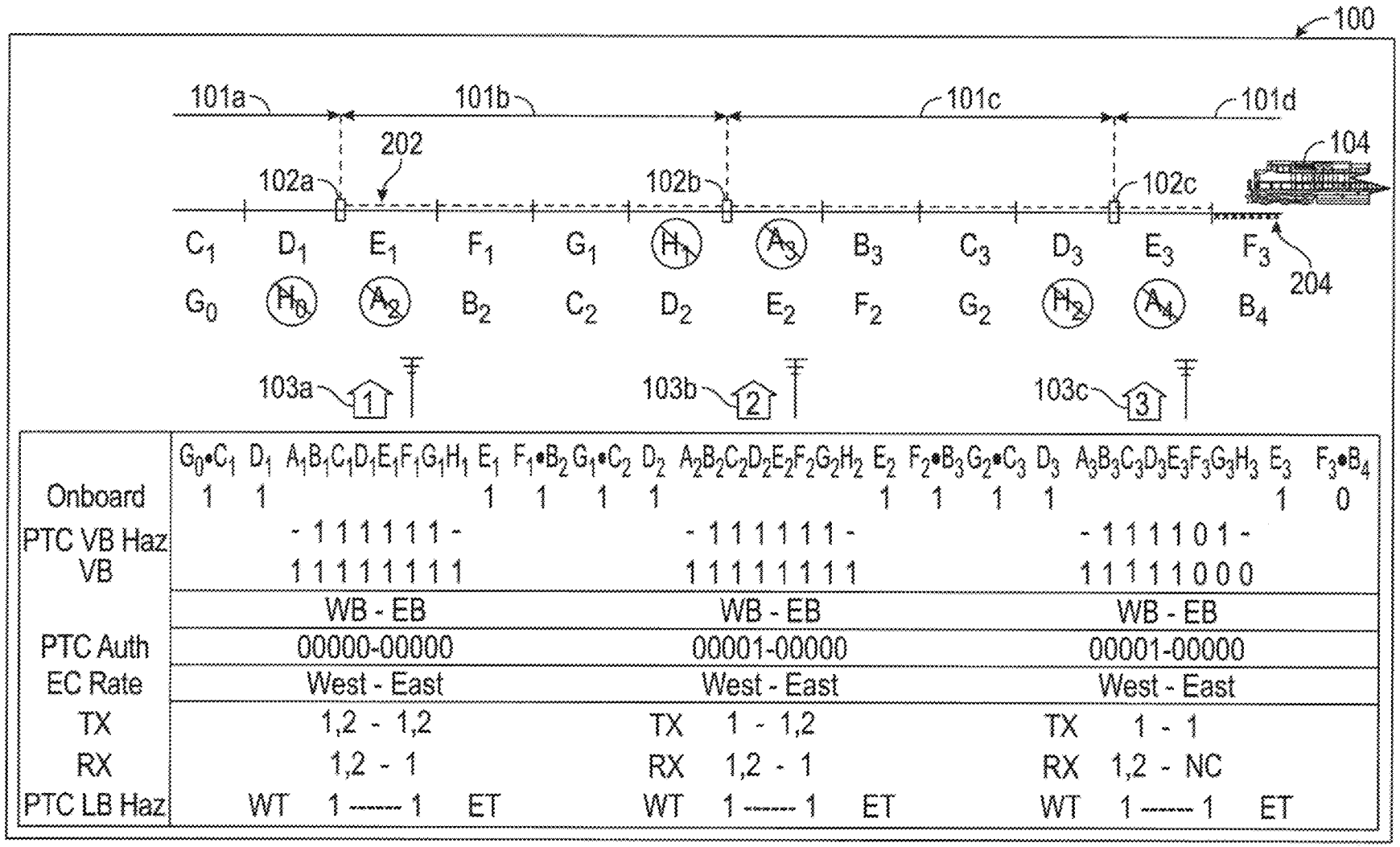
FIG. 5 illustrates a diagram showing the system of FIG. 1, with a westbound train entering a $F_3$ virtual block and corresponding message values, in accordance with one or more exemplary embodiments of the present disclosure.

Referring to FIG. 5, as the train continues west-bound, the train then occupies a section of the track 204 and shunts the $F_3 \cdot B_4$ virtual block. The system can broadcast the shunt at VB $F_3 \cdot B_4$ to the train, but the system can also stick the state of the following virtual block $G_3 \cdot C_4$ high (e.g., 1) for PTC VB Hazard, since the $G_3 \cdot C_4$ virtual block is no longer visible but the system has determined that there is a shunt at virtual block $F_3 \cdot B_4$. As the system sticks $G_3 \cdot C_4$ high, it only broadcasts the status of the known shunt to the train and not the status of the others. So even though the chassis knows these are unknown the system does not care.

When the train 104 shunts virtual block $F_3 \cdot B_4$, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 1 | 1 | 0 | 1 | — |
| VB | 1 | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 |

When the train 104 shunts virtual block $F_3 \cdot B_4$, by 'AND'-ing the two overlapping perspectives for each virtual block, the system will generate and transmit the following virtual block statuses to the locomotive onboard computer:

| | Blk 101a | | | | Blk 101b | | | | Blk 101c | | | | Blk 101d | | | |
|---|---|---|---|---|---|---|---|---|---|---|---|---|---|---|---|---|
| House #1 | — | $B_1$ | $C_1$ | $D_1$ | $E_1$ | $F_1$ | $G_1$ | — | | | | | | | | |
| House #2 | | | | | — | $B_2$ | $C_2$ | $D_2$ | $E_2$ | $F_2$ | $G_2$ | — | | | | |
| House #3 | | | | | | | | | — | $B_3$ | $C_3$ | $D_3$ | $E_3$ | $F_3$ | $G_3$ | — |
| Onboard | | | 1 | 1 | 1 | 1 | 1 | 1 | 1 | 1 | 1 | 1 | 1 | 0 | | |

Figure 6:
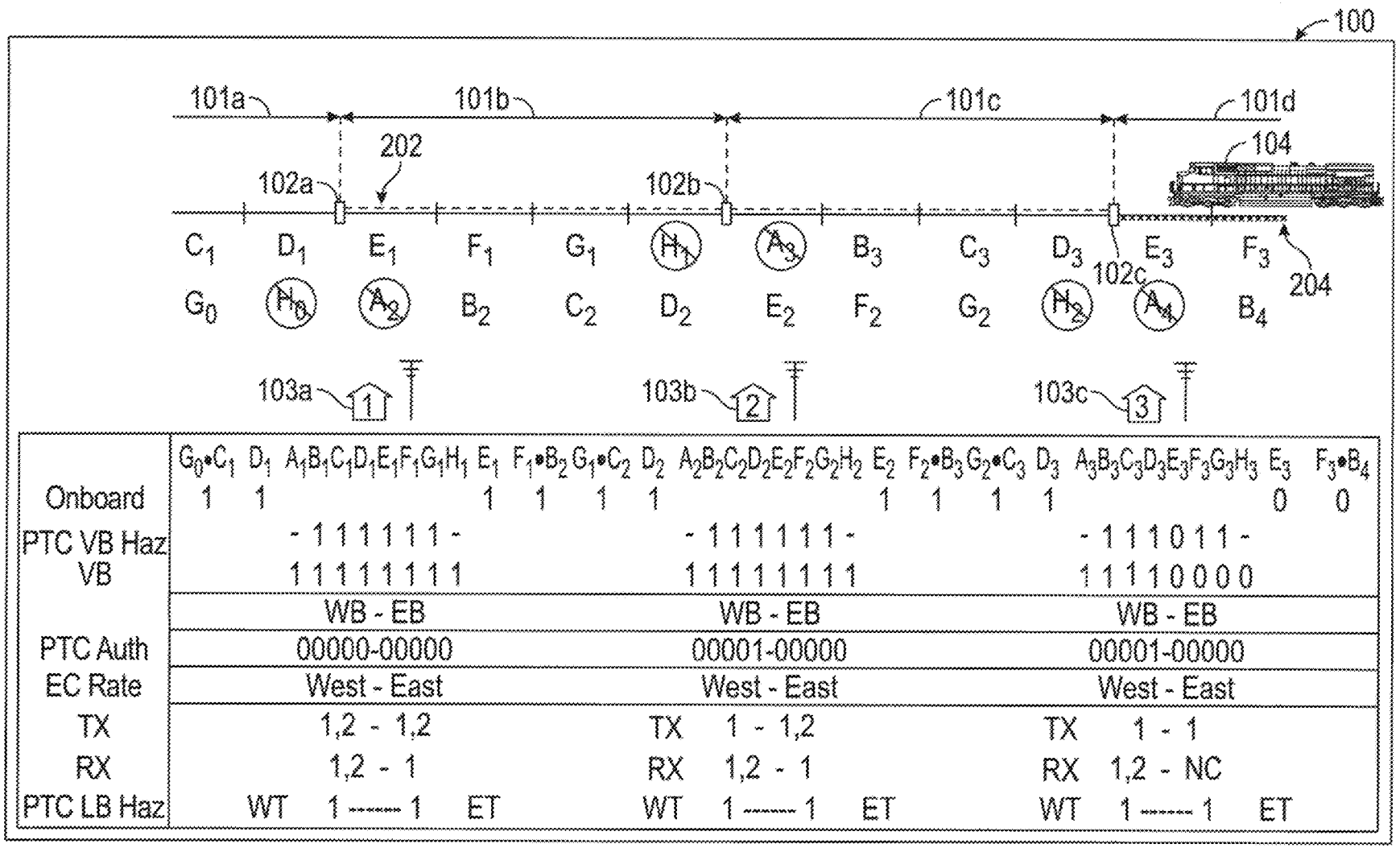
FIG. 6 illustrates a diagram showing the system of FIG. 1, with a westbound train entering a $E_3$ virtual block and corresponding message values, in accordance with one or more exemplary embodiments of the present disclosure.

Referring to FIG. 6, as the train continues west-bound, the train then occupies a section of the track 204 and shunts the $E_3$ virtual block (virtual block $A_4$ is discarded as virtual block $E_3$ has the better perspective). At this point, the $F_3 \cdot B_4$ virtual block is no longer visible but the system has determined that there is a shunt at virtual block $E_3$. The system sticks $F_3 \cdot B_4$ high and only broadcasts the status of the known shunt to the train and not the status of the others.

When the train 104 shunts virtual block $E_3$, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 1 | 0 | 1 | 1 | — |
| VB | 1 | 1 | 1 | 1 | 1 | 1 | 1 | 1 | 1 | 1 | 1 | 1 | 1 | 1 | 1 | 1 | 1 | 1 | 1 | 1 | 0 | 0 | 0 | 0 |

When the train 104 shunts virtual block $E_3$, by 'AND'-ing the two overlapping perspectives for each virtual block, the system will generate and transmit the following virtual block statuses to the locomotive onboard computer:

| | Blk 101a | | | | Blk 101b | | | | Blk 101c | | | | Blk 101d | | | |
|---|---|---|---|---|---|---|---|---|---|---|---|---|---|---|---|---|
| House #1 | — | $B_1$ | $C_1$ | $D_1$ | $E_1$ | $F_1$ | $G_1$ | — | | | | | | | | |
| House #2 | | | | | — | $B_2$ | $C_2$ | $D_2$ | $E_2$ | $F_2$ | $G_2$ | — | | | | |
| House #3 | | | | | | | | | — | $B_3$ | $C_3$ | $D_3$ | $E_3$ | $F_3$ | $G_3$ | — |
| Onboard | | | 1 | 1 | 1 | 1 | 1 | 1 | 1 | 1 | 1 | 1 | 0 | 0 | | |

Figure 7:
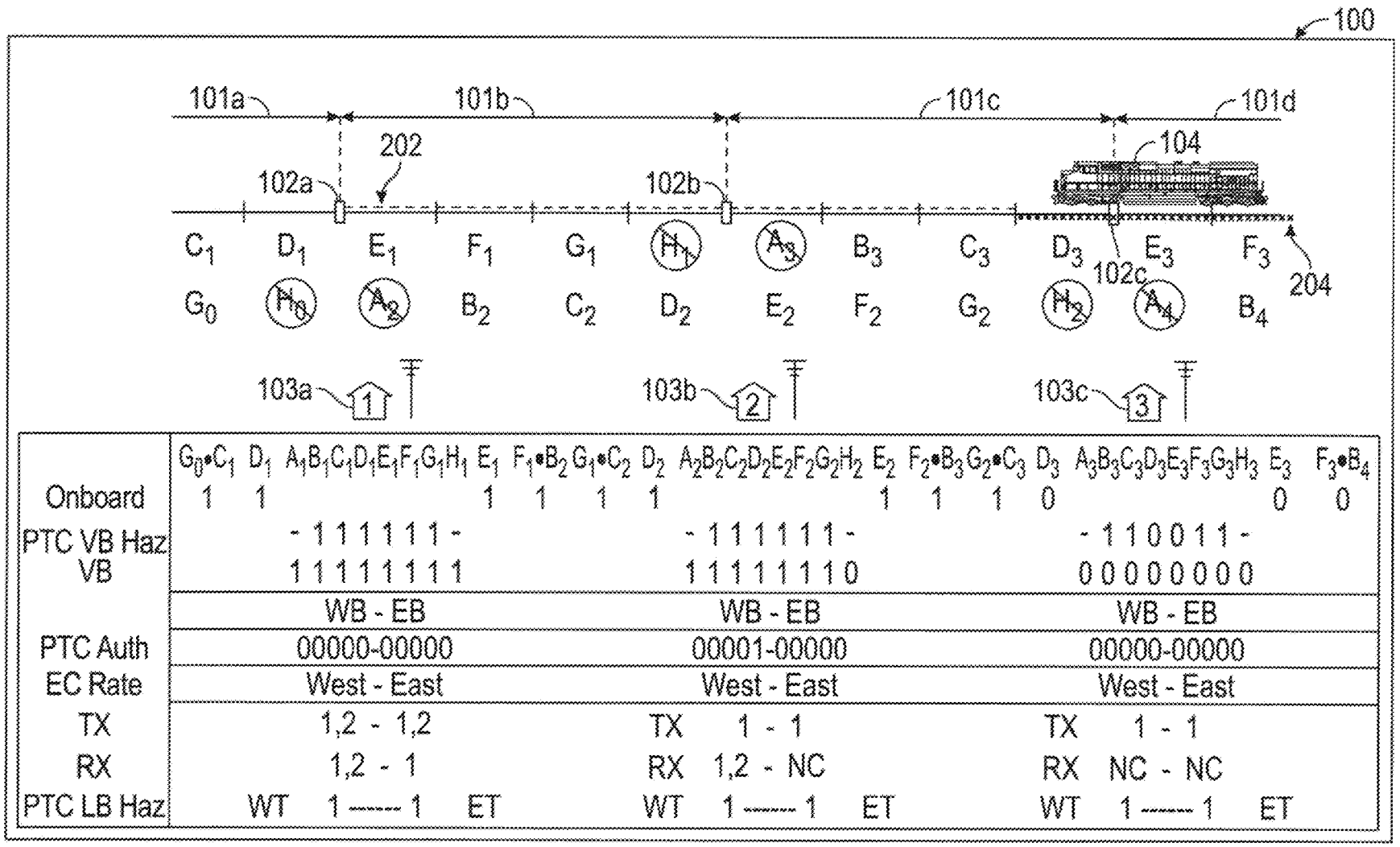
FIG. 7 illustrates a diagram showing the system of FIG. 1, with a westbound train entering a $D_3$ virtual block and corresponding message values, in accordance with one or more exemplary embodiments of the present disclosure.

Referring to FIG. 7, as the train continues west-bound, the train then occupies a section of the track 204 and shunts the $D_3$ virtual block (virtual block $H_2$ is discarded as virtual block $D_3$ has the better perspective). At this point, virtual blocks $F_2 \cdot B_3$ and $G_2 \cdot C_3$ are no longer visible to house #3, but the system has determined that there is a shunt at virtual block $D_3$. $F_2 \cdot B_3$ and $G_2 \cdot C_3$ are no longer truing-up this calculation and the system is using the perspective of house #3 to determine the state of these of these blocks. The system sticks virtual blocks $F_2 \cdot B_3$ and $G_2 \cdot C_3$ high until $D_3$ is unoccupied. The system also clears the west-bound PTC Auth to 00000, as the train 104 has passed house #3. When the train crossed insulated joint 102*c*, the system rescinded the west-bound movement authority so it is no longer there for the next train.

When the train 104 shunts virtual block $D_3$, the system will identify the following states for each of the virtual blocks for each house:

| | House #1 | | | | | | | | House #2 | | | | | | | | House #3 | | | | | | | |
|---|---|---|---|---|---|---|---|---|---|---|---|---|---|---|---|---|---|---|---|---|---|---|---|---|
| | $A_1$ | $B_1$ | $C_1$ | $D_1$ | $E_1$ | $F_1$ | $G_1$ | $H_1$ | $A_2$ | $B_2$ | $C_2$ | $D_2$ | $E_2$ | $F_2$ | $G_2$ | $H_2$ | $A_3$ | $B_3$ | $C_3$ | $D_3$ | $E_3$ | $F_3$ | $G_3$ | $H_3$ |
| PTC VB Haz | — | 1 | 1 | 1 | 1 | 1 | 1 | — | — | 1 | 1 | 1 | 1 | 1 | 1 | — | — | 1 | 1 | 0 | 0 | 1 | 1 | — |
| VB | 1 | 1 | 1 | 1 | 1 | 1 | 1 | 1 | 1 | 1 | 1 | 1 | 1 | 1 | 1 | 0 | 1 | 1 | 1 | 1 | 0 | 0 | 0 | 0 |

When the train 104 shunts virtual block $D_3$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 1 1 | 1 1 1 0 | 0 0 |

Figure 8:
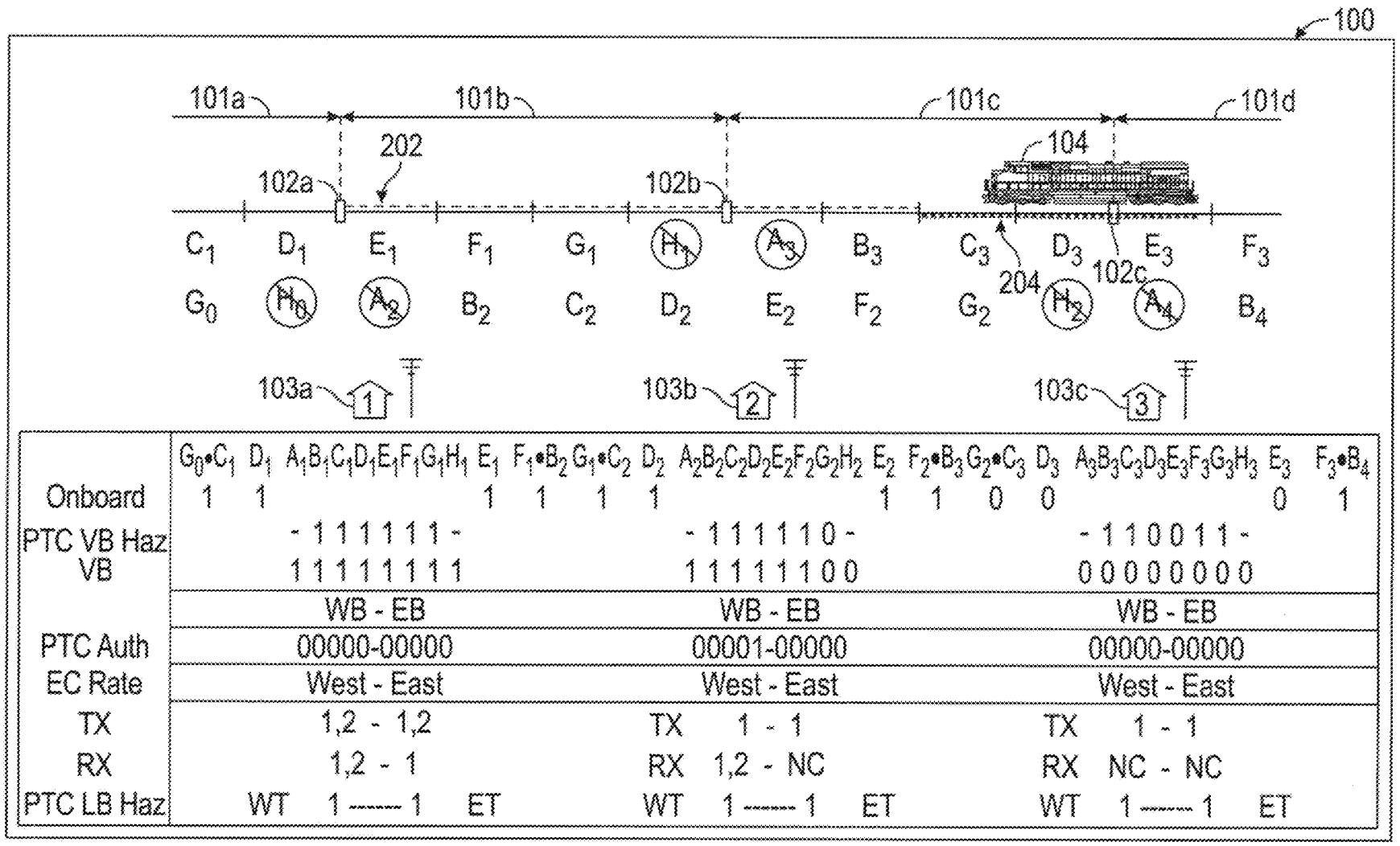
FIG. 8 illustrates a diagram showing the system of FIG. 1, with a westbound train entering a $C_3$ virtual block and corresponding message values, in accordance with one or more exemplary embodiments of the present disclosure.

Referring to FIG. 8, as the train continues west-bound, the train then occupies a section of the track 204 and shunts the $G_2 \cdot C_3$ virtual block. At this point, virtual blocks $F_2 \cdot B_3$ and $G_2 \cdot C_3$ are no longer visible to house #3, but the system has determined that there is a shunt at virtual block $D_3$. The system cannot see beyond $G_2 \cdot C_3$ from the perspective of house #3, so house #3 sticks $F_2 \cdot B_3$ and $G_2 \cdot C_3$ high but house #2 can see virtual block $G_2 \cdot C_3$ shunted and therefore configures the $G_2 \cdot C_3$ virtual block status down. The system can stick virtual blocks $F_2 \cdot B_3$ and $G_2 \cdot C_3$ high until $D_3$ is unoccupied.

When the train 104 shunts virtual block $G_2 \cdot C_3$, the system will identify the following states for each of the virtual blocks for each house:

| | House #1<br>$A_1$ $B_1$ $C_1$ $D_1$<br>$E_1$ $F_1$ $G_1$ $H_1$ | House #2<br>$A_2$ $B_2$ $C_2$ $D_2$<br>$E_2$ $F_2$ $G_2$ $H_2$ | House #3<br>$A_3$ $B_3$ $C_3$ $D_3$<br>$E_3$ $F_3$ $G_3$ $H_3$ |
|---|---|---|---|
| PTC VB Haz | — 1 1 1 1 1 1 — | — 1 1 1 1 1 0 — | — 1 1 0 0 1 1 — |
| VB | 1 1 1 1 1 1 1 1 | 1 1 1 1 1 1 0 0 | 1 1 1 1 0 0 0 0 |

When the train 104 shunts virtual block $G_2 \cdot C_3$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 1 1 | 1 1 0 0 | 0 1 |

Figure 9:
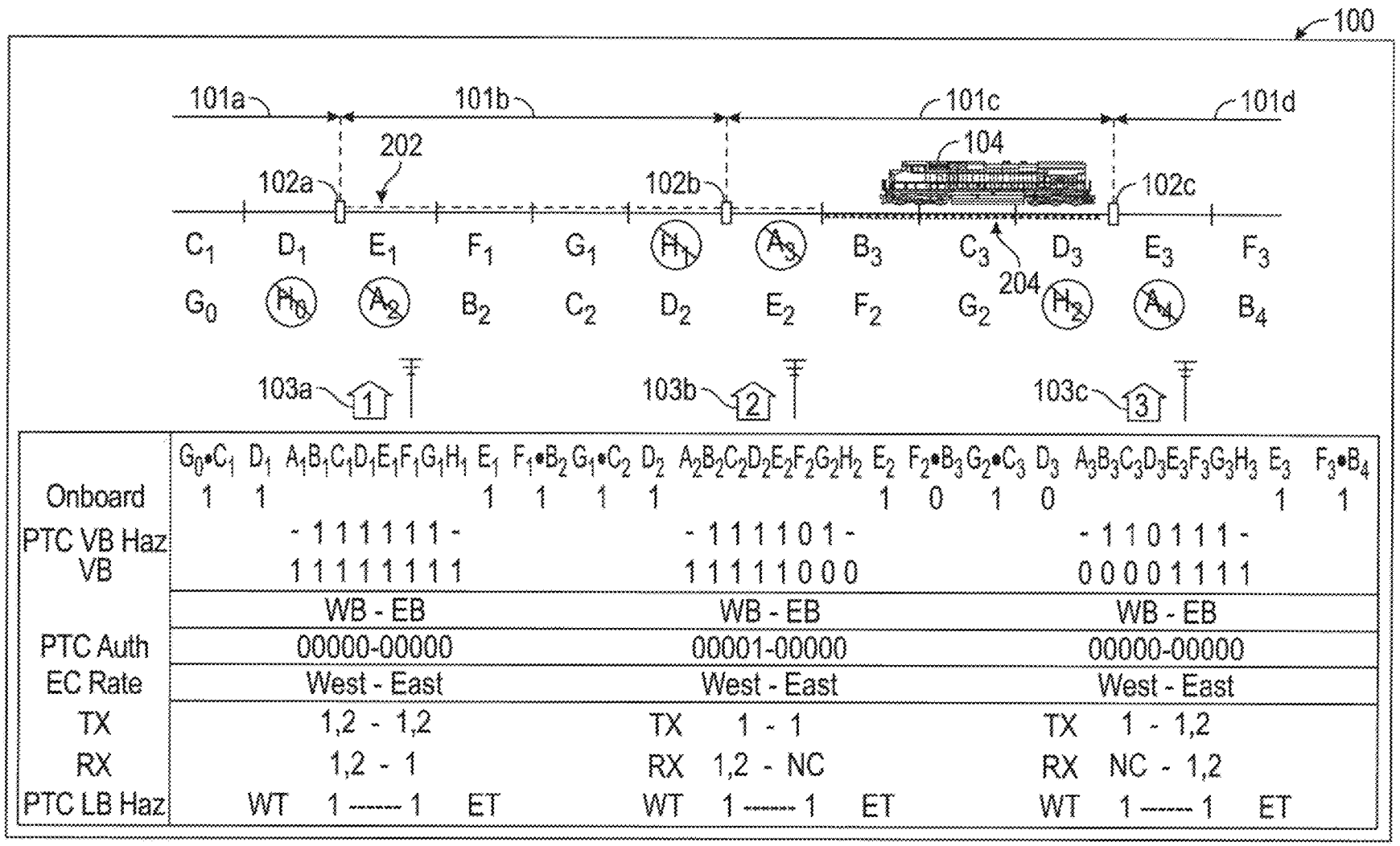
FIG. 9 illustrates a diagram showing the system of FIG. 1, with a westbound train entering a $B_3$ virtual block and corresponding message values, in accordance with one or more exemplary embodiments of the present disclosure.

Referring to FIG. 9, as the train continues west-bound, the train then occupies a section of the track 204 and shunts the $F_2 \cdot B_3$ virtual block. At this point, virtual blocks $F_2 \cdot B_3$ and $G_2 \cdot C_3$ are no longer visible to house #3, but the system has determined that there is a shunt at virtual block $D_3$. The system can stick virtual blocks $F_2 \cdot B_3$ and $G_2 \cdot C_3$ high until $D_3$ is unoccupied.

When the train 104 shunts virtual block $F_2 \cdot B_3$, the system will identify the following states for each of the virtual blocks for each house:

| | House #1<br>$A_1$ $B_1$ $C_1$ $D_1$<br>$E_1$ $F_1$ $G_1$ $H_1$ | House #2<br>$A_2$ $B_2$ $C_2$ $D_2$<br>$E_2$ $F_2$ $G_2$ $H_2$ | House #3<br>$A_3$ $B_3$ $C_3$ $D_3$<br>$E_3$ $F_3$ $G_3$ $H_3$ |
|---|---|---|---|
| PTC VB Haz | — 1 1 1 1 1 1 — | — 1 1 1 1 0 1 — | — 1 1 0 1 1 1 — |
| VB | 1 1 1 1 1 1 1 1 | 1 1 1 1 1 0 0 0 | 0 0 0 0 1 1 1 1 |

When the train 104 shunts virtual block $F_2 \cdot B_3$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 1 1 | 1 0 1 0 | 1 1 |

Figure 10:
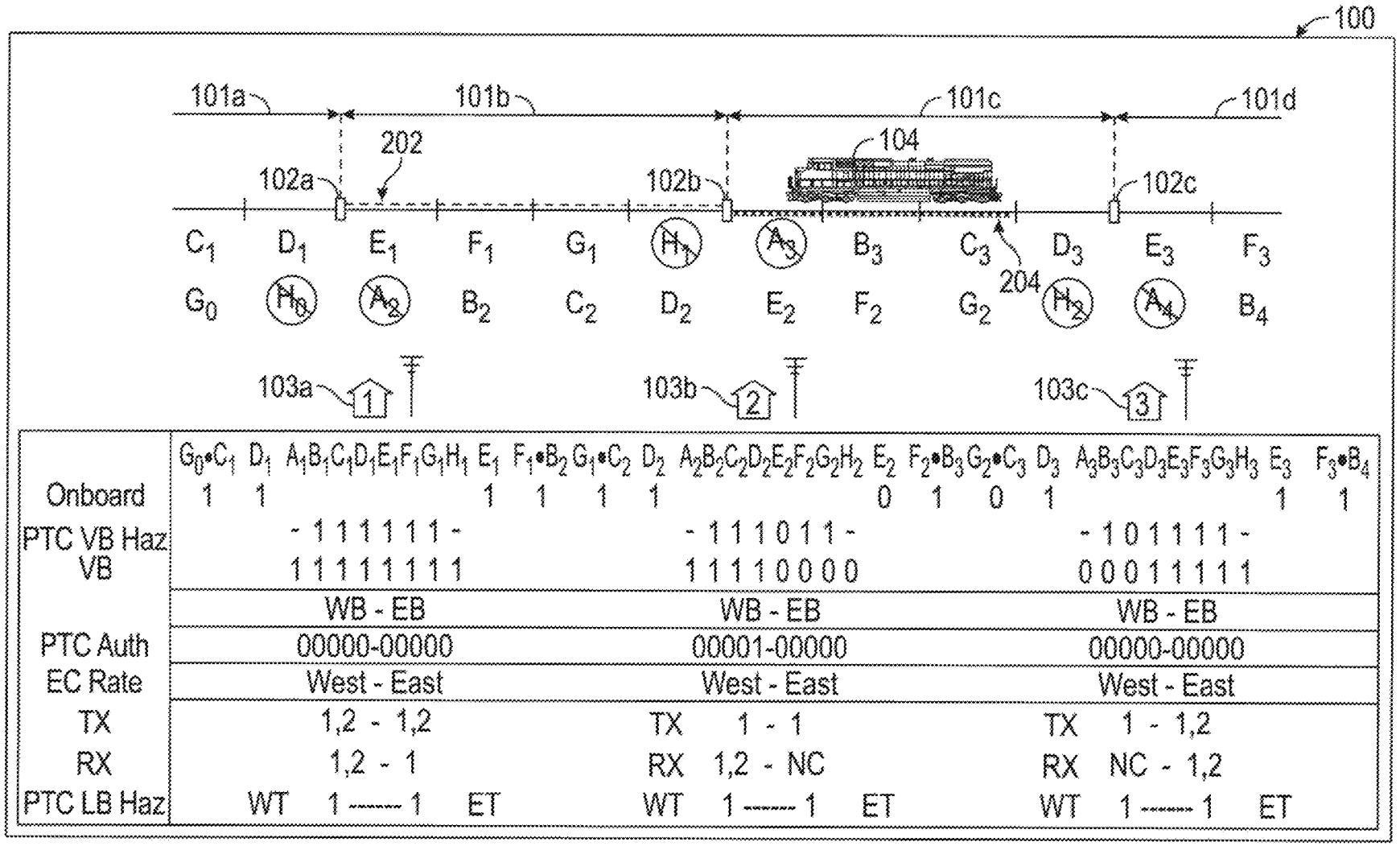
FIG. 10 illustrates a diagram showing the system of FIG. 1, with a westbound train entering a $E_2$ virtual block and corresponding message values, in accordance with one or more exemplary embodiments of the present disclosure.

Referring to FIG. 10, as the train continues west-bound, the train then occupies a section of the track 204 and shunts the $E_2$ virtual block. At this point, $D_3$ is unoccupied and so recovers high, as unoccupied. Virtual block $G_2 \cdot C_3$ is now visible to house #3 and low (0). Virtual block $F_2 \cdot B_3$ is not visible so PTC VB Haz will be stuck high for a time defined by the railroad.

When the train 104 shunts virtual block $E_2$, the system will identify the following states for each of the virtual blocks for each house:

| | House #1<br>$A_1$ $B_1$ $C_1$ $D_1$<br>$E_1$ $F_1$ $G_1$ $H_1$ | House #2<br>$A_2$ $B_2$ $C_2$ $D_2$<br>$E_2$ $F_2$ $G_2$ $H_2$ | House #3<br>$A_3$ $B_3$ $C_3$ $D_3$<br>$E_3$ $F_3$ $G_3$ $H_3$ |
|---|---|---|---|
| PTC VB Haz | — 1 1 1 1 1 1 — | — 1 1 1 0 1 1 — | — 1 0 1 1 1 1 — |
| VB | 1 1 1 1 1 1 1 1 | 1 1 1 1 0 0 0 0 | 0 0 0 1 1 1 1 1 |

When the train 104 shunts virtual block $E_2$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 1 1 | 0 1 0 1 | 1 1 |

Figure 11:
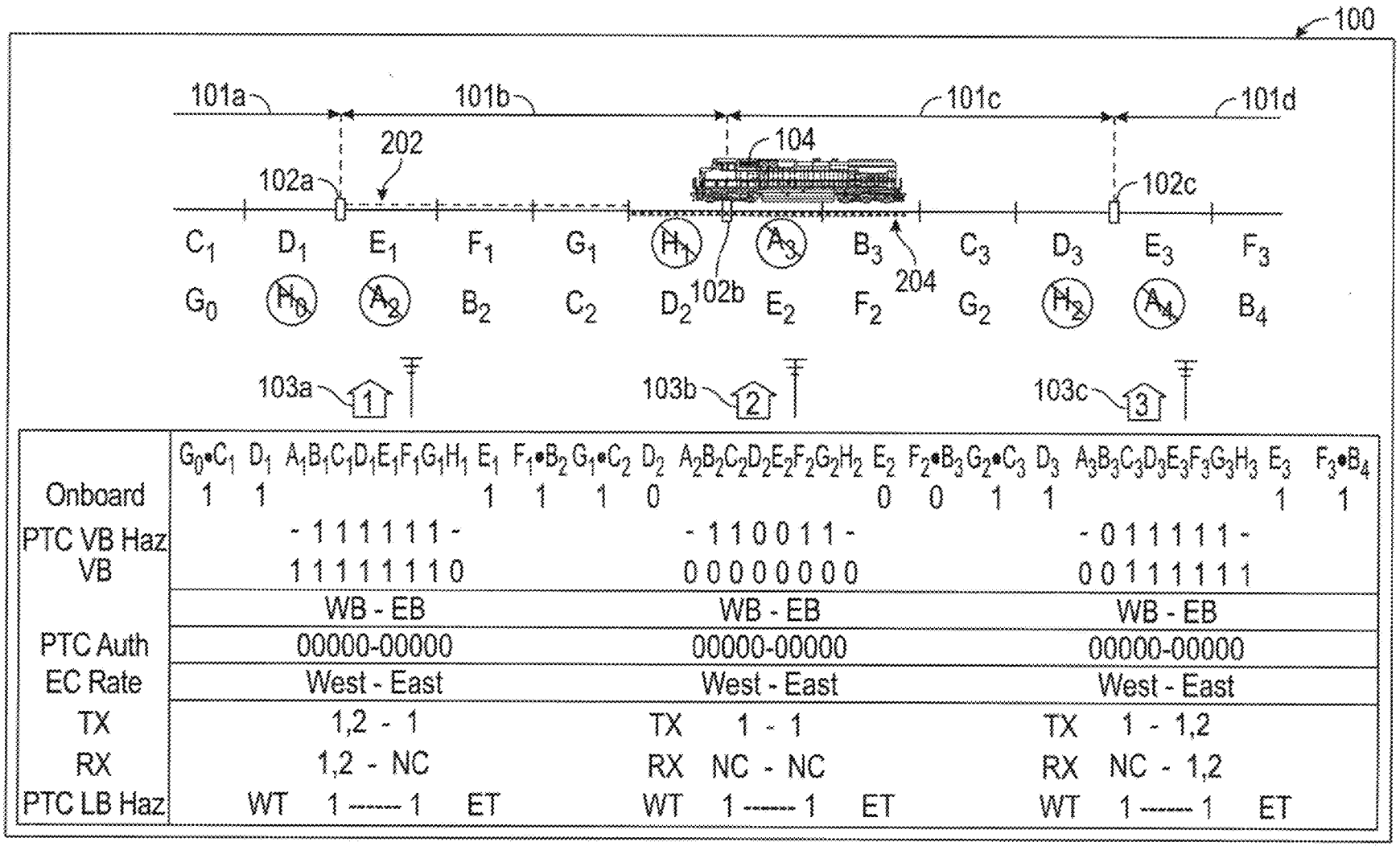
FIG. 11 illustrates a diagram showing the system of FIG. 1, with a westbound train entering a $D_2$ virtual block and corresponding message values, in accordance with one or more exemplary embodiments of the present disclosure.

Referring to FIG. 11, as the train continues west-bound, the train then occupies a section of the track 204 and shunts the $D_2$ virtual block. At this point, $C_3$ is unoccupied and so recovers high, as unoccupied. Virtual block $F_2 \cdot B_3$ is now visible to house #3 and low (0). The system also clears the west-bound PTC Auth to 00000, as the train 104 has passed house #2. When the train 104 crossed insulated joint 102*b*, the system rescinded the west-bound movement authority so it is no longer in place for the next train.

When the train 104 shunts virtual block $D_2$, the system will identify the following states for each of the virtual blocks for each house:

| | House #1 $A_1$ $B_1$ $C_1$ $D_1$ $E_1$ $F_1$ $G_1$ $H_1$ | House #2 $A_2$ $B_2$ $C_2$ $D_2$ $E_2$ $F_2$ $G_2$ $H_2$ | House #3 $A_3$ $B_3$ $C_3$ $D_3$ $E_3$ $F_3$ $G_3$ $H_3$ |
|---|---|---|---|
| PTC VB Haz | — 1 1 1 1 1 1 — | — 1 1 0 0 1 1 — | — 0 1 1 1 1 1 — |
| VB | 1 1 1 1 1 1 1 0 | 0 0 0 0 0 0 0 0 | 0 0 1 1 1 1 1 1 |

When the train 104 shunts virtual block $D_2$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 1 0 | 0 0 1 1 | 1 1 |

Figure 12:
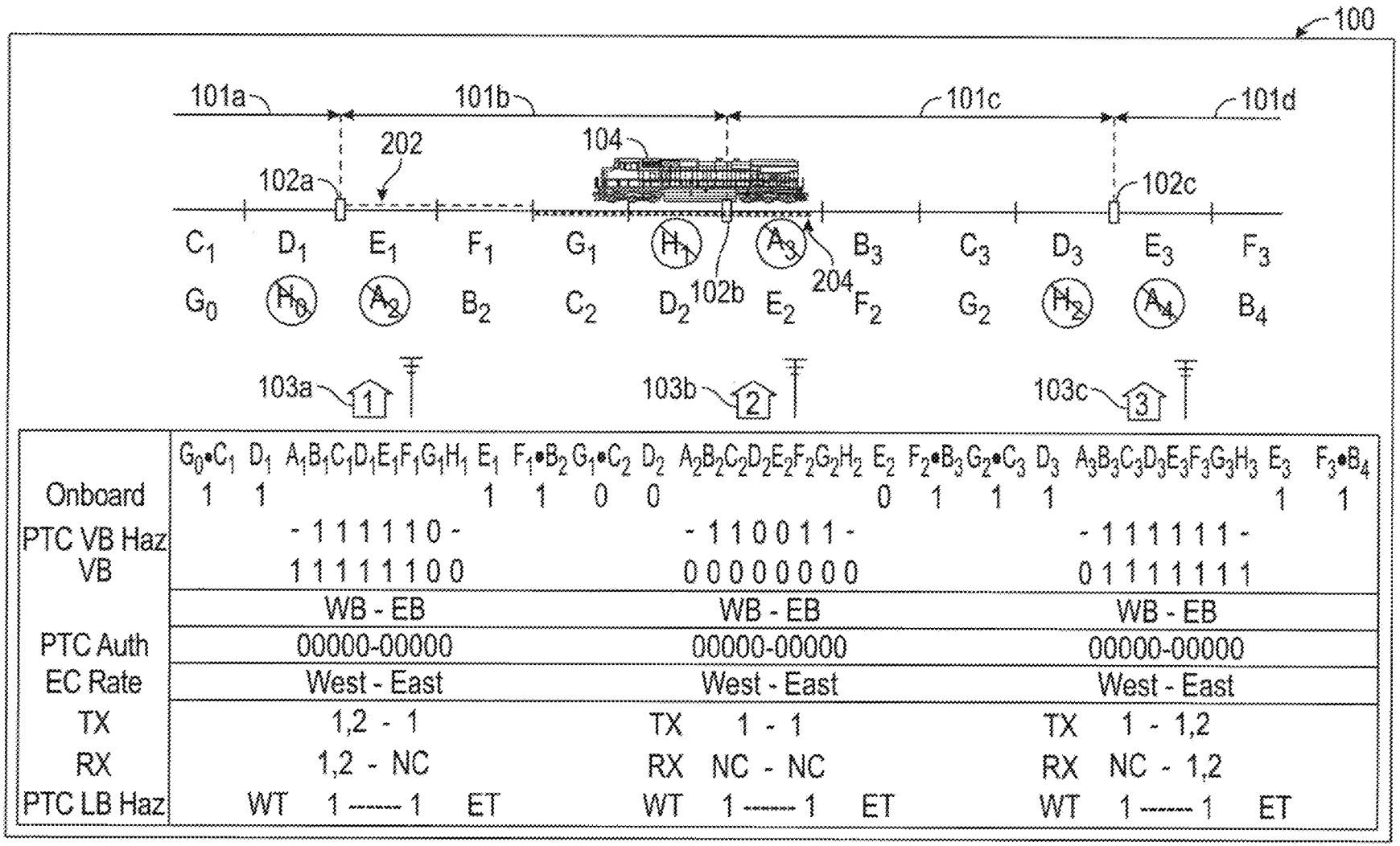
FIG. 12 illustrates a diagram showing the system of FIG. 1, with a westbound train entering a $C_2$ virtual block and corresponding message values, in accordance with one or more exemplary embodiments of the present disclosure.

Referring to FIG. 12, as the train continues west-bound, the train then occupies a section of the track 204 and shunts the $G_1 \cdot C_2$ virtual block. At this point, $B_3$ is unoccupied and so recovers high, as unoccupied. Virtual block $E_2$ is now visible to house #3 and low (0).

When the train 104 shunts virtual block $G_1 \cdot C_2$, the system will identify the following states for each of the virtual blocks for each house:

| | House #1 $A_1$ $B_1$ $C_1$ $D_1$ $E_1$ $F_1$ $G_1$ $H_1$ | House #2 $A_2$ $B_2$ $C_2$ $D_2$ $E_2$ $F_2$ $G_2$ $H_2$ | House #3 $A_3$ $B_3$ $C_3$ $D_3$ $E_3$ $F_3$ $G_3$ $H_3$ |
|---|---|---|---|
| PTC VB Haz | — 1 1 1 1 1 0 — | — 1 1 0 0 1 1 — | — 1 1 1 1 1 1 — |
| VB | 1 1 1 1 1 1 0 0 | 0 0 0 0 0 0 0 0 | 0 1 1 1 1 1 1 1 |

When the train 104 shunts virtual block $G_1 \cdot C_2$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 1 0 0 | 0 1 1 1 | 1 1 |

Figure 13:
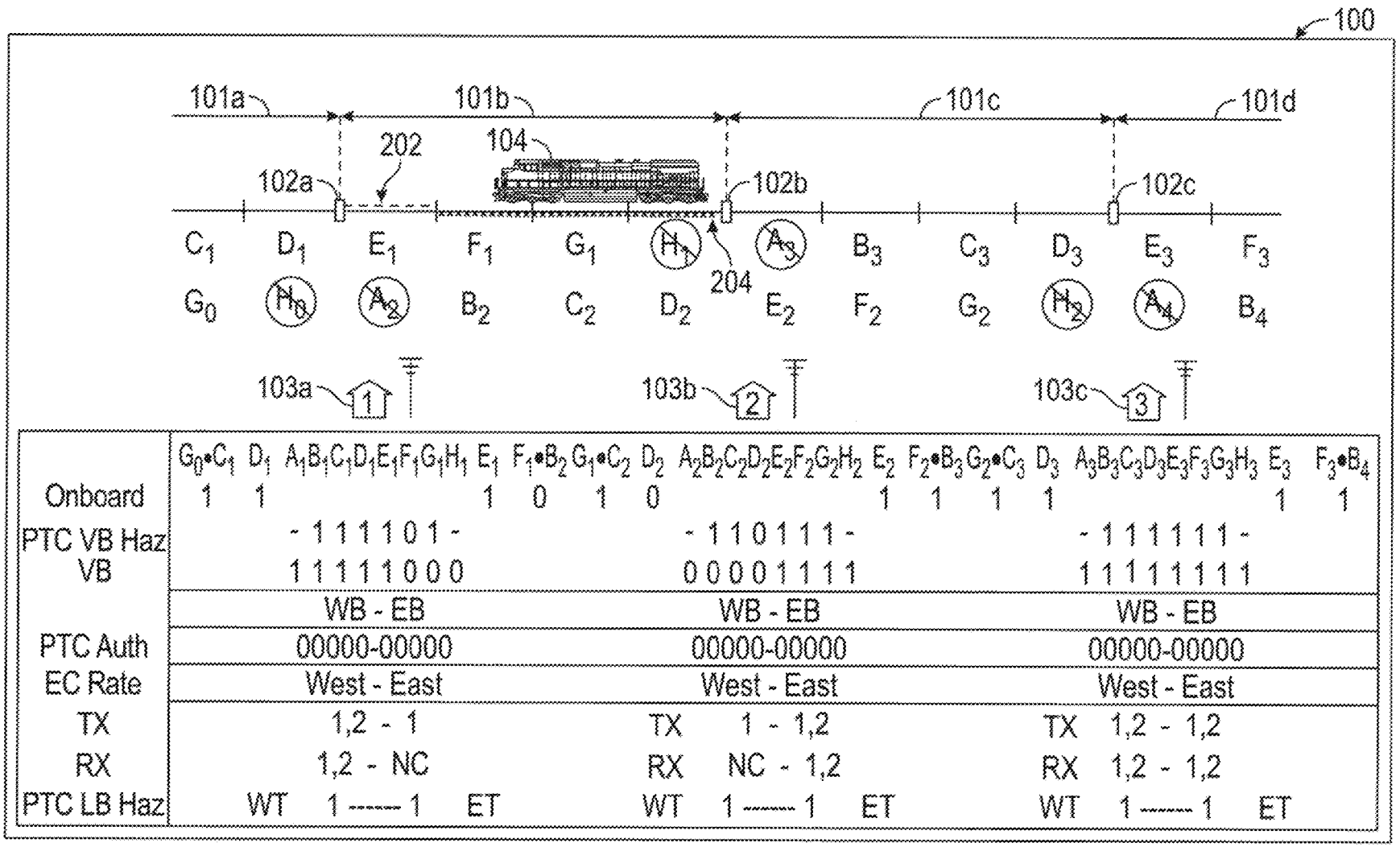
FIG. 13 illustrates a diagram showing the system of FIG. 1, with a westbound train entering a $B_2$ virtual block and corresponding message values, in accordance with one or more exemplary embodiments of the present disclosure.

Referring to FIG. 13, as the train continues west-bound, the train then occupies a section of the track 204 and shunts the $F_1 \cdot B_2$ virtual block. At this point, $E_2$ is unoccupied and so recovers high, as unoccupied. Virtual block $D_2$ is low (0).

When the train 104 shunts virtual block $F_1 \cdot B_2$, the system will identify the following states for each of the virtual blocks for each house:

| | House #1 $A_1$ $B_1$ $C_1$ $D_1$ $E_1$ $F_1$ $G_1$ $H_1$ | House #2 $A_2$ $B_2$ $C_2$ $D_2$ $E_2$ $F_2$ $G_2$ $H_2$ | House #3 $A_3$ $B_3$ $C_3$ $D_3$ $E_3$ $F_3$ $G_3$ $H_3$ |
|---|---|---|---|
| PTC VB Haz | — 1 1 1 1 0 1 — | — 1 1 0 1 1 1 — | — 1 1 1 1 1 1 — |
| VB | 1 1 1 1 1 0 0 0 | 0 0 0 0 1 1 1 1 | 1 1 1 1 1 1 1 1 |

When the train 104 shunts virtual block $F_1 \cdot B_2$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 1 0 1 0 | 1 1 1 1 | 11 |

Figure 14:
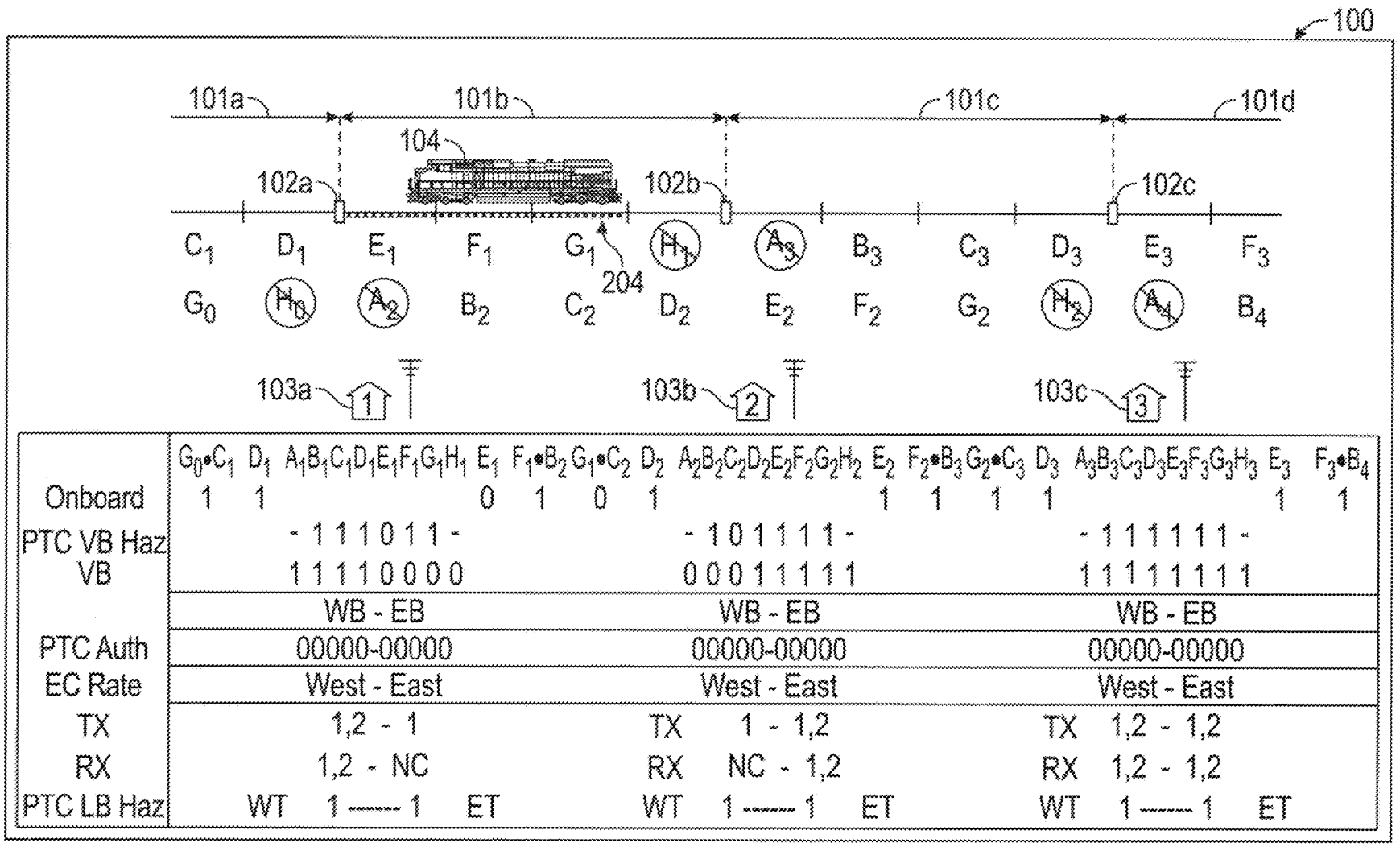
FIG. 14 illustrates a diagram showing the system of FIG. 1, with a westbound train entering a $E_1$ virtual block and corresponding message values, in accordance with one or more exemplary embodiments of the present disclosure.

Referring to FIG. 14, as the train continues west-bound, the train then occupies a section of the track 204 and shunts the $E_1$ virtual block. At this point, $D_2$ is unoccupied and so recovers high, as unoccupied. Virtual block $G_1 \cdot C_2$ is low (0). The train has now reached the end of its authority and can repeat the process to advance to another location.

When the train 104 shunts virtual block $E_1$, the system will identify the following states for each of the virtual blocks for each house:

| | House #1 $A_1$ $B_1$ $C_1$ $D_1$ $E_1$ $F_1$ $G_1$ $H_1$ | House #2 $A_2$ $B_2$ $C_2$ $D_2$ $E_2$ $F_2$ $G_2$ $H_2$ | House #3 $A_3$ $B_3$ $C_3$ $D_3$ $E_3$ $F_3$ $G_3$ $H_3$ |
|---|---|---|---|
| PTC VB Haz | — 1 1 1 0 1 1 — | — 1 0 1 1 1 1 — | — 1 1 1 1 1 1 — |
| VB | 1 1 1 1 0 0 0 0 | 0 0 0 1 1 1 1 1 | 1 1 1 1 1 1 1 1 |

When the train 104 shunts virtual block $E_1$, by 'AND'-ing the two overlapping perspectives for each virtual block, the system will generate and transmit the following virtual block statuses to the locomotive onboard computer:

| | Blk 101a | Blk 101b | Blk 101c | Blk 101d |
|---|---|---|---|---|
| House #1 | — $B_1$ $C_1$ $D_1$ | $E_1$ $F_1$ $G_1$ — | | |
| House #2 | | — $B_2$ $C_2$ $D_2$ | $E_2$ $F_2$ $G_2$ — | |
| House #3 | | | — $B_3$ $C_3$ $D_3$ | $E_3$ $F_3$ $G_3$ — |
| Onboard | 1 1 | 0 1 0 1 | 1 1 1 1 | 1 1 |

Figure 15:
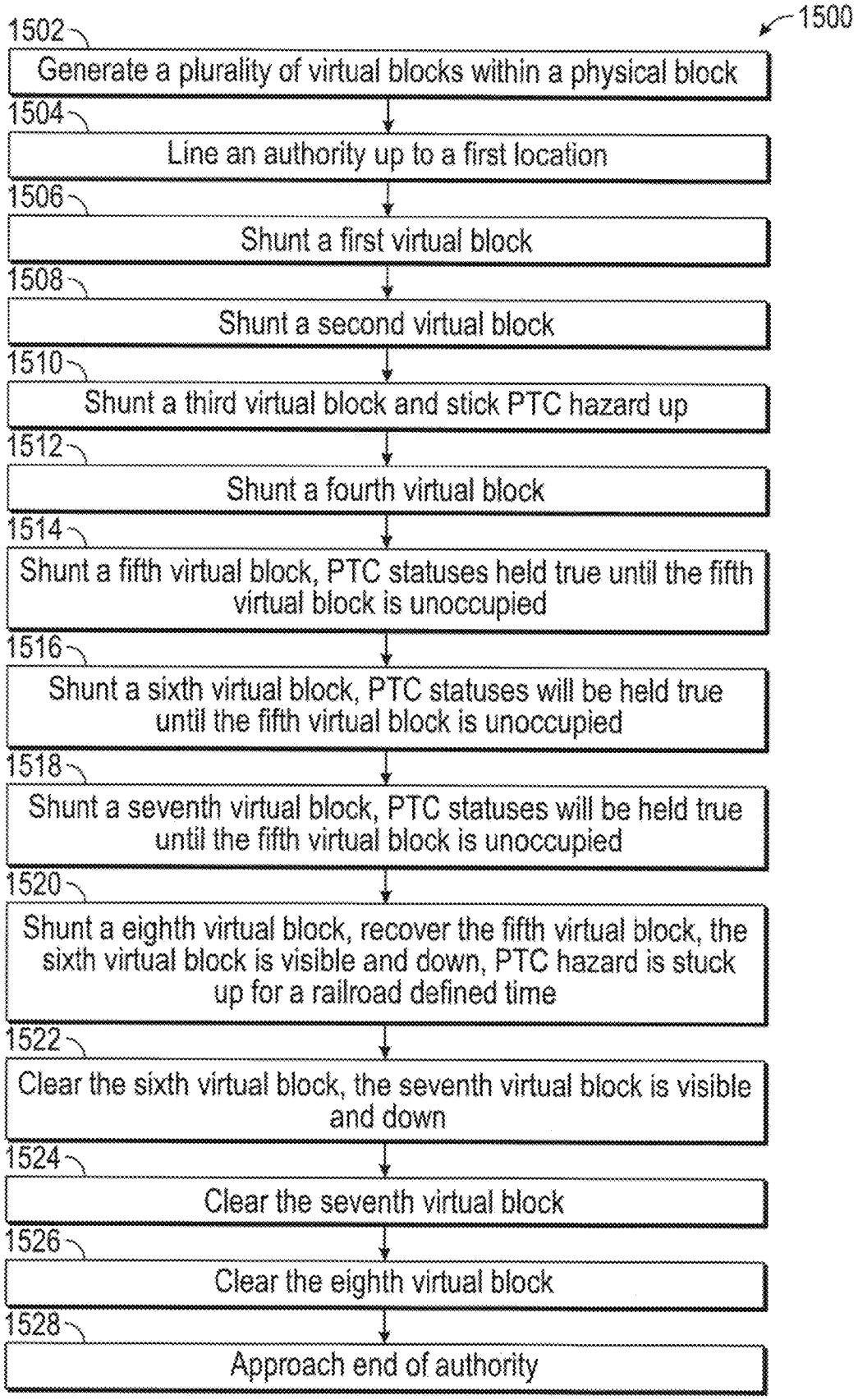
FIG. 15 illustrates a flowchart exemplifying Virtual Block control logic in accordance with one or more exemplary embodiments of the present disclosure.

FIG. 15 illustrates a flow chart diagram exemplifying control logic 1500 embodying features of a method of virtual block detection within occupied block using stick logic, in accordance with an exemplary embodiment of the present disclosure. The VB detection control logic 1500 can be implemented as an algorithm on a computer processor (e.g., vital logic controller, onboard computer, server), a machine learning module, or other suitable system. Additionally, the VB detection control logic 1500 can be achieved with software, hardware, an application programming interface (API), a network connection, a network transfer protocol, HTML, DHTML, JavaScript, Dojo, Ruby, Rails, other suitable applications, or a suitable combination thereof. The VB detection control logic 1500 (e.g., computer processor) can be capable of executing machine-readable instructions to perform program steps and operably coupled to a memory having a first database with a plurality of messages, signal values, and specifications related to a vehicle and at least a portion of a track. The messages can include Onboard, PTC VB Haz, VB, PTC Auth, EC Rate, TX, RX, PTC LB Haz, or other suitable messages. The messages can have fields and data associated thereto.

The VB detection control logic 1500 can leverage the ability of a computer platform to spawn multiple processes and threads by processing data simultaneously. The speed and efficiency of the VB detection control logic 1500 can be greatly improved by instantiating more than one process to facilitate virtual block detection. However, one skilled in the art of programming will appreciate that use of a single processing thread may also be utilized and is within the scope of the present disclosure. VB detection control logic 1500 can also be distributed amongst a plurality of networked computer processors. The computer processors can be located in the wayside houses 103 or onboard the train 104.

The VB detection control logic 1500 process flow of the present embodiment begins at step 1502, wherein the control logic 1500 can generate a plurality of virtual blocks within a physical block. In one embodiment, the control logic 300 can be configured to receive data from sensors or other data-gatherers on and/or by a railroad track and instantiating the control logic 1500 at step 1502 can prepare the control logic 1500 to receive and process the anticipated data. The control logic 1500 then proceeds to step 1504.

At step 1504, the control logic 1500 can line an authority up to a first location. For example, the control logic 1500 can send a PTC Auth message to the relevant wayside houses to ensure authority to move along the track. In another embodiment, the control logic 1500 can indicate a direction of travel. The control logic 1500 then proceeds to step 1506.

At step 1506, the control logic 1500 can assign a shunt value to a first virtual block (e.g., VB $G_3$) (not shown). In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the first virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 then proceeds to step 1508.

At step 1508, the control logic 1500 can assign a shunt value to a second virtual block (e.g., VB $G_3$) (not shown). In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the second virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 then proceeds to step 1510.

At step 1510, the control logic 1500 can assign a shunt value to a third virtual block (e.g., VB $F_3$) and stick PTC Hazard high. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the third virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 can assign a value for a status bit associated with a particular virtual block. For example, the control logic 1500 can stick a PTC VB Haz value high (e.g., 1) by assigning a logic '1' value to the bit for the associated virtual block. The control logic 1500 then proceeds to step 1512.

At step 1512, the control logic 1500 can assign a shunt value to a fourth virtual block (e.g., VB $E_3$). In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the fourth virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 then proceeds to step 1514.

At step 1514, the control logic 1500 can assign a shunt value to a fifth virtual block (e.g., VB $D_3$) and hold the PTC statuses true until the fifth virtual block is unoccupied. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the fifth virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. From the perspective of house #3 103*c*, because the train is headed westbound and the fifth virtual block shunts any signals transmitted westbound, house #3 103*c* cannot see past the shunt in the fifth virtual block. The control logic 1500 can also "stick" a bit value for a particular virtual block to a specific value despite its measured value. In one embodiment, the control logic 1500 can assign a value to a status bit associated with a particular virtual block. For example, the control logic 1500 can stick a PTC VB Haz message bit value high (e.g., 1) by assigning a logic '1' value to the bit for the associated virtual block. The control logic 1500 then proceeds to step 1516.

At step 1516, the control logic 1500 can assign a shunt value to a sixth virtual block (e.g., VB $C_3$), PTC statuses will be held true until the fifth virtual block is unoccupied. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the sixth virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 can also "stick" a bit value to a particular value despite the measured value. For example, the control logic 1500 can assign a value for a status bit associated with a particular virtual block. For example, the control logic 1500 can stick a PTC VB Haz message bit value high (e.g., 1) by assigning a logic '1' value to the bit for the associated virtual block. The control logic 1500 then proceeds to step 1518.

At step 1518, the control logic 1500 can assign a shunt value to a seventh virtual block (e.g., VB $B_3$), PTC statuses will be held true until the fifth virtual block (e.g., VB $D_3$) is unoccupied. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the seventh virtual block based upon one or more measurements taken by a wayside house, for example, house #3 103*c*. The control logic 1500 can assign a status value low (e.g., 0) to indicate that the virtual block is shunted, and therefore occupied by a train or hazard. For example, the bit value of the relevant bit of a PTC VB Haz or VB message can be assigned by the control logic 1500. The control logic 1500 can also "stick" a bit value to a particular value despite the measured value. For example, the control logic 1500 can assign a value for a status bit associated with a particular virtual block. For example, the control logic 1500 can stick a PTC VB Haz message bit value high (e.g., 1) by assigning a logic '1' value to the bit for the associated virtual block. The control logic 1500 then proceeds to step 1520.

At step 1520, the control logic 1500 can assign a shunt value to an eighth virtual block (e.g., VB $A_3$), recover the fifth virtual block (e.g., VB $D_3$), the sixth virtual block (e.g., VB $C_3$) is visible and down, PTC hazard is stuck up for a railroad defined time. In one embodiment, the control logic 1500 can determine a shunt based upon an electrical signal sent along the rails. In another embodiment, the shunt can be determined based upon the measured impedance, or time of receipt of a signal. In another embodiment, the control logic can identify the location of the shunt in the fifth virtual block based upon one or more measurements taken by a wayside house, for example, house #3 103*c*. The control logic 1500 can assign a status value low (e.g., 0) to indicate that the virtual block is shunted, and therefore occupied by a train 104 or hazard. For example, the bit value of the relevant bit of a PTC VB Haz or VB message can be assigned by the control logic 1500. From the perspective of house #3 103*c*, because the train is headed westbound and the eight virtual block is the furthest virtual block from house #3, the control logic 1500 can recover the bit value for the fifth virtual block as the fifth virtual block is measured as unoccupied as the rear of the train has passed house #3. But since the sixth virtual block has the end of the train shunting it, the sixth virtual block is visible but down (e.g., occupied). In one embodiment, the control logic 1500 can remove the "stuck" bit values and assign the measured bit statuses in the PTC VB Haz message for one or more virtual blocks. The PTC VB Haz can be stuck up by the control logic 1500 for a time defined by the railroad. The control logic 1500 then proceeds to step 1522.

At step 1522, the control logic 1500 can clear the sixth virtual block (e.g., VB $C_3$), the seventh virtual block (e.g., VB $B_3$) is visible and down. Since the perspective of house #3 only advances to the $8^{th}$ virtual block (e.g., VB $A_3$), house #3 can no longer see which VBs are shunted by the westbound front of the train 104 as the train enters those VBs, but the control logic 1500 can monitor the rear of the train as it departs the virtual blocks associated with house #3. Accordingly, the control logic 1500 can clear the status of the sixth virtual block from the perspective of house #3. The control logic 1500 then proceeds to step 1524.

At step 1524, the control logic 1500 can clear the seventh virtual block (e.g., VB $B_3$). The control logic 1500 can clear the status of the sixth virtual block from the perspective of house #3. The control logic 1500 then proceeds to step 1526.

At step 1526, the control logic 1500 can clear the eighth virtual block (e.g., VB $A_3$). The control logic 1500 can clear the status of the sixth virtual block from the perspective of house #3, as the train 104 no longer occupies any of house #3's virtual blocks. The control logic 1500 then proceeds to step 1528.

At step 1528, the control logic 1500 can approach end of authority. In one embodiment, the train 104 reaches the first location and therefore has no authority to proceed. The train must again request movement authority to a second location to begin travel. The control logic 1500 can then terminate or repeat the aforementioned steps as the train receives a second movement authority to the second location.

In other words, the method of virtual block detection within occupied block using stick logic, can utilize the control logic 1500 to generate a plurality of virtual blocks within a physical block, associate a bit in a message with each of the plurality of virtual blocks, initialize the message bits to a first bit value, receive an authority up to a first location, assign a second bit value for a first virtual block when a train occupies a first virtual block, stick one or more virtual block bit values to the first bit value regardless of the train's presence in the virtual block when the control logic 1500 determines that those values are not relevant because of a train's position, and set a bit associated with the first virtual block to the first bit value as the train leaves the virtual block. In one embodiment, the first bit value can be high (e.g., a logical '1') to indicate the absence of a train 104 or hazard in a virtual block. In another exemplary embodiment, the second bit value can be low (e.g., a logical '0') to indicate the presence of a train 104 or hazard in a virtual block. The control logic 1500 can mask certain states that may be unnecessary to determine the status of a virtual block so it can be acted upon appropriately by or for the onboard system. The control logic 1500 can "stick" certain values high when it is determined that those values are not relevant because of the train position and use only those bits having relevant information for the onboard to act. For example, the control logic 1500 can determine that certain bit values are not relevant to virtual block occupancy information because the train's position may be blocking the perspective of one of the houses 103.

The present disclosure achieves at least the following advantages:

1. prevent a following train from thinking it can occupy tracks in advance of itself that may be occupied by another train;
2. determine the location of a head end and a tail end of a train; and
3. broadcast information to the train using industry standard protocols and use the onboard computer to interpret received data based on industry standard code.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this disclosure should not be read as implying that any particular element, step, or function can be an essential or critical element that must be included in the claim scope. Also, none of the claims can be intended to invoke 35 U.S.C. § 112 (f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112 (f). Even under the broadest reasonable interpretation, in light of this paragraph of this specification, the claims are not intended to invoke 35 U.S.C. § 112 (f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the inventions can be established by the appended claims rather than by the foregoing description. All changes which come within the meaning and range of equivalency of the claims are therefore intended to be embraced therein. Further, the individual clements of the claims are not well-understood, routine, or conventional. Instead, the claims are directed to the unconventional inventive concept described in the specification.

What is claimed is:

1. A system for virtual block state identification, comprising:

a memory having a first database with a plurality of values related to a virtual block and at least a portion of a track; and a processor operably coupled to the memory and capable of executing machine-readable instructions to perform program steps, the program steps including:

generating, via the processor, a plurality of virtual blocks within a physical block;

receiving an authority to allow a train to move along a railroad track to a first location;

assigning a shunt value to a first virtual block;

assigning a shunt value to a second virtual block;

assigning a shunt value to a third virtual block; and sticking a message value high for a particular virtual block to prevent a following train from advancing into tracks that may be occupied.

2. The system of claim 1, the program steps further comprising indicating a direction of travel.

3. The system of claim 1, the program steps further comprising identifying the location of the shunt in the first virtual block based upon one or more measurements taken by a wayside house.

4. The system of claim 1, the program steps further comprising identifying the location of the shunt in the second virtual block based upon one or more measurements taken by a wayside house.

5. The system of claim 1, the program steps further comprising determining the location of a head end and a tail end of the train.

6. The system of claim 1, the program steps further comprising broadcasting information to the train using industry standard protocols and use the onboard computer to interpret received data based on industry standard code.

7. The system of claim 1, wherein different message types and corresponding values for each message type are based upon an occurrence.

8. The system of claim 1, wherein the message is a PTC Virtual Block Hazard message representing a PTC message and the specific payload is a type of hazard.

9. The system of claim 1, wherein a logic value can be configured to be a safe state.

10. The system of claim 1, wherein the message is stuck high for a railroad-defined time.

11. A method of virtual block state identification, the method comprising:

generating, via a processor, a plurality of virtual blocks within a physical block;

receiving an authority to allow a train to move along a railroad track to a first location;

assigning a shunt value to a first virtual block;

assigning a shunt value to a second virtual block;

assigning a shunt value to a third virtual block; and sticking a message value high for a particular virtual block to prevent a following train from advancing into tracks that may be occupied.

12. The method of claim 11, further comprising indicating a direction of travel.

13. The method of claim 11, further comprising identifying the location of the shunt in the first virtual block based upon one or more measurements taken by a wayside house.

14. The method of claim 11, further comprising identifying the location of the shunt in the second virtual block based upon one or more measurements taken by a wayside house.

15. The method of claim 11, further comprising determining the location of a head end and a tail end of the train.

16. The method of claim 11, further comprising broadcasting information to the train using industry standard protocols and use the onboard computer to interpret received data based on industry standard code.

17. The method of claim 11, wherein different message types and corresponding values for each message type are based upon an occurrence.

18. The method of claim 11, wherein the message is a PTC Virtual Block Hazard message representing a PTC message and the specific payload is a type of hazard.

19. The method of claim 11, wherein a logic value can be configured to be a safe state.

20. The method of claim 11, wherein the message is stuck high for a railroad-defined time.

* * * * *